US008590302B2

(12) United States Patent
Risla Nes

(10) Patent No.: US 8,590,302 B2
(45) Date of Patent: Nov. 26, 2013

(54) THERMODYNAMIC CYCLE AND HEAT ENGINE

(75) Inventor: Harald Risla Nes, Lillesand (NO)

(73) Assignee: Viking Heat Engines AS (NO)

( * ) Notice: Subject to any disclaimer, the term of this patent is extended or adjusted under 35 U.S.C. 154(b) by 0 days.

(21) Appl. No.: 13/636,073

(22) PCT Filed: Mar. 25, 2011

(86) PCT No.: PCT/NO2011/000105

§ 371 (c)(1),
(2), (4) Date: Oct. 9, 2012

(87) PCT Pub. No.: WO2011/119046

PCT Pub. Date: Sep. 29, 2011

(65) Prior Publication Data

US 2013/0121847 A1 May 16, 2013

(30) Foreign Application Priority Data

Mar. 26, 2010 (NO) ..... 20100447
Feb. 14, 2011 (NO) ..... 20110250

(51) Int. Cl.
*F01B 29/10* (2006.01)
*F25B 9/00* (2006.01)
*F25B 13/00* (2006.01)

(52) U.S. Cl.
USPC ..... 60/521; 60/522; 60/524; 62/6; 62/324.1; 62/325

(58) Field of Classification Search
USPC ..... 60/517–526; 62/6, 324.1–324.6, 325
See application file for complete search history.

(56) References Cited

U.S. PATENT DOCUMENTS 2,791,881 A * 5/1957 Denker ..... 60/619
4,133,172 A 1/1979 Cataldo (Continued)

OTHER PUBLICATIONS

"A Dual-Source Organic Rankine Cycle (DORC) for Improved Efficiency in Conversion of Dual Low- and Mid-Grade Heat Sources"—F. David Doty and Siddarth Shevgoor, Proceedings of the ASME 2009 3rd International Conference of Energy Sustainability, Doty Scientific, Inc., Jul. 19-23, 2009, San Francisco, California, USA.

(Continued)

*Primary Examiner* — Hoang Nguyen
(74) *Attorney, Agent, or Firm* — Andrus, Sceales, Starke & Sawall, LLP

(57) ABSTRACT

A method and arrangement are for heat exchanging in and work exchanging with a working fluid in a heat engine, or a heat pump if the method and its sub-processes are substantially reversed. A thermodynamic cycle for the working fluid is approximately described through the polytropic relation $PV^n$=constant, where P is the pressure, V is the volume and n is the polytropic index of the working fluid with adiabatic index gamma (γ), and wherein the engine consists of at least one working mechanism provided with a first and at least a second volume change chamber, the method comprising in sequence at least the following steps: in a first volume change process, to carry out a first polytropic volume change of the working fluid in a first volume change chamber where $n<\gamma$, and in a second volume change process, to carry out at least one second near-adiabatic or polytropic volume change of the working fluid from a first to a second volume change chamber, where $n<\gamma$, or where a volume change starts with $n<\gamma$ and ands near-adiabatic ($n\approx\gamma$).

18 Claims, 13 Drawing Sheets

(56) References Cited

U.S. PATENT DOCUMENTS

| | | | | |
|---|---|---|---|---|
| 4,393,653 | A | 7/1983 | Fischer | |
| 5,311,739 | A | 5/1994 | Clark | |
| 7,076,941 | B1 | 7/2006 | Hoffman et al. | |
| 7,975,485 | B2 * | 7/2011 | Zhao et al. | 60/712 |
| 2008/0202454 | A1 * | 8/2008 | Pirault | 123/58.8 |
| 2009/0000294 | A1 | 1/2009 | Misselhorn | |

OTHER PUBLICATIONS

International Search Report for parent application PCT/NO2011/000105, having a mailing date of Jun. 20, 2011.

Written Opinion for parent application PCT/NO2011/000105, having a mailing date of Jun. 20, 2011.

* cited by examiner

THERMODYNAMIC CYCLE AND HEAT ENGINE

CROSS-REFERENCE TO RELATED APPLICATIONS

This application is the U.S. national stage application of International Application No. PCT/NO2011/000105, filed Mar. 25, 2011, which International application was published on Sep. 29, 2011 as International Publication No. WO 2011/119046 A1 in the English language and which application is incorporated herein by reference. The International application claims priority of Norwegian Patent Application Nos. 20100447, filed Mar. 26, 2010, and 20110250, filed Feb. 14, 2011, which applications are incorporated herein by reference.

BACKGROUND

There is described a method for heat exchanging in and work exchanging with a working fluid in a heat engine or a heat pump if the method and its sub-processes are essentially reversed, wherein a thermodynamic cycle for the working fluid is approximately described through the polytropic relation $PV^n$=constant, P representing the pressure, V representing the volume and n representing the polytropic index of the working fluid having adiabatic index gamma ($\gamma$), and wherein the engine consists of at least one work mechanism provided with a first and at least a second volume change chamber.

There is also described a heat engine for use in exercising the method.

Recently there has been substantially increased focus on the utilisation of renewable energy sources. There are many forms of renewable energy available, most of the available, renewable energy being in the form of heat, and, in the end, water energy, wind energy and parts of the ocean energy are products of solar irradiance and thus results of heat energy or thermal energy which is a more formal term.

Thermal energy may be utilised directly, for example to heat water, but generally there is a need to convert the energy to a different form that may be utilised for purposes other than heating. The best example is electrical energy that may be produced by means of a thermal energy engine, also called a thermodynamic engine, or most plainly called a heat engine, which is a more general term. A heat engine is in most cases a mechanical device, which can utilise the temperature difference between a heat reservoir and a cold reservoir to produce mechanical work. From mechanical work, energy in the form of such as electricity may be further produced.

Examples of heat engine types are steam engines, petrol engines, diesel engines, Stirling engines, gas turbines and steam turbines (also called Rankine turbines, which among other places are used in most coal fired power plants and nuclear power plants). There exist many more types. Petrol and diesel engines and also gas turbines are characterised as internal combustion engines, as the heat energy for these is obtained by internal combustion of fuel. Steam engines and Stirling engines utilise heat from external combustion and are therefore often called external combustion engines.

The term external combustion engine may often be misleading as the heat energy for a so-called external combustion engine may just as well come from the sun or another form of heat source not requiring combustion of a fuel. Another example of a heat source without combustion is geothermal heat or ground heat as it is also called. This heat is latent in the earth's crust or even deeper. The term external combustion engine may therefore advantageously be replaced by external heat engine or engine with external heat supply, which is a more appropriate term.

With new international requirements regarding reduction of greenhouse gas emissions and also use of non-renewable energy sources, there turns out to be a strongly increasing need for renewable energy sources. In this connection there is also a growing need to be able to utilise heat at lower temperatures, such as from geothermal wells or solar energy plants. An important observation here is that the lower the source temperature the more energy is available and the cheaper it is to procure. The available heat energy may be divided into for example two groups defined as low-grade and high-grade heat energy, low-grade energy being defined as heat having a temperature below what may be utilised in traditional steam turbines, which for some technologies start at such as 150° C., while other technologies utilise temperatures from 300° C. High-grade heat sources then have typical temperatures above this. The drawback in utilising heat energy at low temperatures is that the theoretical maximum for the efficiency is low, but as long as there is enough energy available, this is less important.

Nevertheless, one may get improved utilisation of the total available energy by combining different energy sources, for example by supplementing low-grade heat energy with high-grade heat energy, the total efficiency being relatively high, without all the heat needing to come from an "expensive", high-grade reservoir.

Today there are several technologies that in several cases solely use low-grade heat sources. Examples of these are Stirling engines and "Organic Rankine Cycle" turbines, so-called ORC turbines. ORC turbines follow the Rankine cycle just like traditional steam turbines, but instead of water they often use an organic working fluid having a low boiling point at atmospheric pressure such as pentane (boils at 36° C. at 1 atmosphere), diethyl ether or toluene, hence the name part "Organic". By using a fluid having a low boiling point, heat energy at temperatures well below 100° C. (normal boiling point for water) may be utilised.

Current low temperature technology has a few drawbacks, giving large room for further improvement. ORC solutions require for example relatively advanced turbine technology, making this technology less available in areas where the technical expertise is low, the use of this technology furthermore entailing large costs. ORC plants require in addition large evaporator tanks, as the working fluid for the ORC turbines ideally speaking must be evaporated completely before it enters the turbine itself, thus requiring large volumes for heat exchangers. If this is not satisfied, one may in several types of turbines get blade erosion as a result of the large forces that presence of liquid in the turbine may involve. If the blades in a turbine erode, it will be destroyed. In addition, turbines are generally adiabatic, that is to say no heat is added during the expansion, contrary to such as Stirling engines where a near isothermal (or more real polytropic) expansion takes place. The Stirling technology has also several challenges turning out to be difficult to solve, large demands being made on inter alia material properties and heat exchangers, where materials and the remainder of components required for Stirling engines are not normally found as standard goods within the most common engine industries. This makes the Stirling technology very costly, and advanced expertise is required for production and maintenance in the use of this technology.

SUMMARY

The object of the invention is to remedy or reduce at least one of the disadvantages of the prior art, or at least provide a useful alternative to the prior art.

The object is achieved by the features disclosed in the description below and in the subsequent claims.

The present invention relates to a heat engine and a thermodynamic cycle with external heat supply like in an external heat engine. The invention may be used in connection with energy production from any available heat source having a relevant temperature level.

The invention exploits the principle of supplying extra heat during the expansion itself. One may thus make do with relatively small sizes compared to the output. This is very favourable with regard to weight, quantity of construction material, production costs et cetera. There are many examples of heat engines where heat is supplied during the expansion. Besides engines based on the Stirling or Diesel cycles, one finds in the U.S. Pat. Nos. 7,076,941 (Hoffman), 2009/0000294 (Misselhorn) and 4,133,172 (Cataldo) some more examples of this. The present invention seeks primarily to supply heat during the expansion of a working fluid alternating between the gas and the liquid phases (two-phase principle), what is less widespread.

In one embodiment of the engine two expansion chambers are utilised, which may be given by the working volumes of two cylinders, to expand and supply heat to a working fluid being expanded in and between these, to then be able to achieve two different thermodynamic processes. This invention seeks further in another embodiment to utilise both the rod and piston sides to be able to achieve two different thermodynamic processes in one and the same cylinder. Thus the heat engine size may be further reduced, as one does not have to use two separate cylinders for the two different processes. In inter alia U.S. Pat. No. 4,393,653 (Fischer) there is shown a piston based heat engine utilising both the rod and piston side to form two cylinder chambers. What distinguishes the solution in U.S. Pat. No. 4,393,653 from the invention is that U.S. Pat. No. 4,393,653 utilises the rod side as in a two-stroke engine, where air is sucked in from the surroundings before it is forced further into the upper chamber. In addition one opening of the bypass of U.S. Pat. No. 4,393,653 is defined by the work position of the piston, deviating from the features in the present invention, where the bypass openings must be and are maintained in any of the piston work positions. There are also other examples utilising this double acting principle, bur few utilising the volume "under" the piston for pure expansion. An exception exists in traditional piston based steam engines, but these follow the Rankine cycle, which is not the case for this invention.

In addition the heat engine may utilise heat from two different heat reservoirs, such as from a low-grade and a high-grade heat reservoir as described earlier. The publication "A Dual-Source Organic Rankine Cycle (DORC) for Improved Efficiency in Conversion of Dual Low- and Mid-grade Heat Sources", Doty and Shevgoor, Doty Scientific 2009, gives a detailed description of possible advantages by utilising a double heat reservoir in a thermodynamic cycle, in said publication being represented by ORC.

There is provided a characteristic thermodynamic cycle implemented by a heat engine, the heat engine comprising an engine housing; one or more cylinder assemblies formed by among others a piston, alternatively a piston stem, a connecting rod, a crankshaft, valves, fluid channels and seals; a heating course consisting of one or more recuperators (regenerators) and at least one heater and appurtenant valves; a cooling course consisting of at least one cooler and possibly the recuperator(s) also being used toward the heating course; an injection unit; a liquid reservoir and circulation pumps for thermo-fluids. The cylinder assembly is in a simple and conventional embodiment a two-cylinder arrangement with a crankshaft as synchronising mechanism between the two pistons, like in an ordinary combustion engine. The cylinders may further be defined as a first and a second cylinder, where the fully expanded volume in the second cylinder is larger than the fully expanded volume in the first cylinder, either by the second cylinder having a larger diameter, or the piston in this chamber having a longer stroke, or a combination thereof.

In one embodiment the cylinder assembly is based on a single cylinder divided into two chambers, where the piston acts as a movable partition wall between these, and the piston has further a fixed piston stem fitted on the one side. This side is defined as the first side of the piston and constitutes a first cylinder chamber, where the piston stem in a fluid tight manner is led through a first, axial end portion of the cylinder. The opposite end of the piston is defined as the second side of the piston and forms a second cylinder chamber. The fully expanded volume of the second cylinder chamber is larger than the fully expanded volume of the first cylinder chamber as a consequence of the piston stem taking up a volume in the first cylinder chamber.

The invention is further characterised in that the characteristic, thermodynamic cycle consists of a sequence of thermodynamic processes implemented in that a working fluid in the heat engine first expands when it is heated in the first cylinder chamber when the piston is on its way up, and where it further expands from the first cylinder chamber and into the alternatively relatively adiabatic, second cylinder chamber when the piston is on its way back, a working-fluid bypass with appurtenant valve forming a passage making it possible for substantially all the working fluid to flow from the first to the second cylinder chamber. The engine is further characterised in that the first cylinder chamber functions as a heat exchanger toward the working fluid so that heat may be transferred through the cylinder wall from a thermo-fluid in an outer fluid course and into the working fluid in the chamber, so that extra heat may be fed to the working fluid in the expansion process to thereby achieve an increased effect through-flow in the engine. The engine is also characterised in that work applied on the piston is n distributed between the up-stroke and the down-stroke, which is not normal in most of the known piston engines, except in traditional steam engines. This contributes to distribute the work done by the piston over a greater area of movement, which again may reduce the forces in the engine, as work done (W)=force (F)× distance (s), the distance (s) being increased here. The mechanical loads (generated by F) may then be reduced, and simpler and cheaper materials may be used. The same principle will be valid for a two-cylinder embodiment of the engine.

Even if, in the description, terms as "up" and "down" are used in connection with piston movement, the invention is not physically limited to vertical piston movement. "Up" is to be understood as a direction away from a crankshaft connected to the piston, and "down" means a direction toward the crankshaft.

The invention makes a considerable increase in energy supply possible, and therefore tapping of work per completed cycle, contributing considerably to increase the efficiency (effect per unit volume or unit mass) of the heat engine.

The engine is mainly intended to work according to the two-phase principle, defined by a thermodynamic cycle for a working fluid changing between liquid and gas phase, like the Rankine cycle. It is nevertheless possible to suppose that the cycle and the engine may utilise a working fluid in just one phase, preferably gas phase.

The invention also provides a better utilisation of the heat reservoir temperature level relative to for example ORC, as the time required for heat exchange against the highest temperature level is much less, as the expansion starts at a lower entropy level. This is shown in the T-s diagram in FIG. 16*b*. (The cycles as shown by the curves in the T-s diagrams in FIGS. 16*a* and 16*b* follow a clockwise direction.) In FIG. 16*a* is shown the T-s diagram for an idealised ORC cycle, where the isobaric heat supply process is shown as the upper horizontal line, where the process is terminated by superheating into the dry area for the fluid, that is to say the small "terminating" part of the line pointing diagonally upward from the horizontal, before it again falls. To be able to heat exchange against a fluid at a certain temperature level, the heat source must have a considerably higher temperature to be able to achieve a high heat flux. When next a working fluid is to be evaporated at this temperature, like in an ORC, it means either that the heat exchanger surface must be very large, or that the time that the fluid is left in contact with the surface is long. This is due to the ORC engines utilising turbines as expanders, and these may only expand near-adiabatic, as they do not have internal heat exchangers, thus all the heat must be supplied in advance of the expansion. In the present invention one utilises, on the contrary, another thermodynamic principle, namely that, like for example in the Stirling engine, some heat is supplied during the expansion itself. This turns out to possibly being very favourable, as the expansion brings about a pressure drop decided by natural law and implicitly a temperature drop, making the heat flux possibly becoming high as the temperature difference between the heat exchanger and the fluid is increased during the expansion, so that more heat is supplied faster. This principle is the most important reason for managing without an evaporator, which otherwise is mandatory in an ORC cycle. According to the invention the expansion starts long before the dry zone of the fluid has been reached, as illustrated by the falling curve in FIG. 16*b*, where the temperature drops as the entropy increases. In this part of the cycle also work is extracted from the engine. In an ORC work is extracted only in the adiabatic (isentropic) part of the cycle, as shown by the vertically dropping segment of the curve in FIG. 16*a*.

A fluid in liquid form is pumped from the low-pressure reservoir to the high-pressure heating course by means of the injection unit. The reservoir may be such as a pipe, a liquid tank, or any other device being able to contain a liquid. The working fluid, hereinafter also called the fluid, may be any fluid suitable for the application, such as water, pentane or other organic liquids, various cooling media and so on.

The injection unit, hereinafter also called the injector, may be any device that may be used to pump a fluid from a low to a high pressure. The injector may be arranged to pump the fluid in batches, feed an adjustable flow of fluid or maintain a constant pressure in the fluid at the outlet. At the injector inlet there may be fitted a non-return valve to avoid reversing of the fluid flow. There may likewise be fitted a non-return valve at the injector outlet. The injector may further be mechanically synchronised with the heat engine and be made such that the supplied quantity and the injection time may be adjusted as needed. The injector may further be arranged to be controlled by means of an electronic control system such as an Engine Control Unit (ECU) used for engine control in modern cars.

From the injector outlet the fluid is pumped into the heating course that has the object of supplying heat energy to the fluid. The heating course may be designed such that the fluid goes through multiple steps of heating at different temperature levels. In a first step in the heating course the fluid may flow through a recuperator designed according to known recuperator principles, as this may return some of the waste heat from the heat engine fluid outlet. In a next step or alternatively the first step in the heating course the fluid may flow on into a heater supplying heat from an external heat reservoir. The heating course may in addition contain multiple heating steps utilising heat from various heat reservoirs simultaneously, and preferably from heat reservoirs having higher and sequentially rising temperatures. In this context there may also be added more recuperators with the object of recovering residual heat at the various temperature levels.

The heating course may at its outlet be provided with a pressure threshold valve such as a cycling valve whose function it is to make sure that the pressure in the heating course is always above a certain level. The valve may also be adjustable in accordance with known control principles to allow the flow rate and the pressure of the working fluid flowing out of the heating course to be adjusted according to various needs. The heating course volume may preferably be sized to always keep more working fluid inside the heating course than what is required for injection in one cycle. The benefit of this is that the volume and thus the heat exchanging surfaces in the heating course may be varied according to needs without the rest of the engine design being affected. The heating course will also be able to function as a fluid buffer, which among others strengthens the ability of the engine to be able to adapt to varying load, a quantity of heated fluid always being available for injection into the engine.

In one embodiment of the invention, the fluid may be held in liquid form throughout the heating course by the pressure in the heating course being kept sufficiently high, and the fluid temperature not exceeding the critical fluid point, where the separation between liquid and gas ceases to exist. In another embodiment of the invention the fluid may be heated to well above the critical point, where all or parts of the fluid may transcend to a supercritical state by being in contact with a heat exchanger having a temperature above the critical point. In this way a large heat quantity may be added to the fluid before injection into the heat engine working chambers without the need of a large evaporator tank like in ORC turbines. This presupposes that the injector always provides enough fluid in the heating course, the quantity needed for injection per cycle always being available. The injector always being set to keep the pressure in the heating course above the engine working pressure may for example solve this. This is inter alia known from diesel engines having a common injection manifold, so-called "common-rail" injection, but in that case it concerns fuel injection and not working-fluid injection as in the present invention.

From the heating course the working fluid is injected into the first cylinder chamber, also called the first working chamber, or the expansion chamber, via a working-fluid inlet, hereafter also called a nozzle. The injection may be carried out by the injector on the inlet side of the heating course applying enough pressure to allow the fluid flowing into the heating course to displace a corresponding amount of fluid already present there, causing this amount to flow out of the heating course through the nozzle and into the first cylinder chamber. In another embodiment the injection is carried out by the valve in the heating course outlet opening for liquid through-flow, the injector maintaining the pressure in the heating course always maintaining enough fluid available. In yet another embodiment a desired amount of working fluid may initially be maintained in liquid form until the desired amount is completely injected into the first cylinder chamber. This may be achieved by the injector being arranged to maintain a high enough pressure and a high enough flow rate, the desired amount of working fluid not starting to expand from the liquid form before it is located inside the first expansion chamber. There may in this case also be arranged an extension of the injector, which may be placed at the heating course outlet, or between the heating course outlet and the fluid inlet, providing for further regulation of pressure and flow rate of the working fluid.

The first work chamber functions as a first expander by the upward movement (downward in a two-cylindered embodiment) of the piston increasing the volume thereof. The nozzle may be fitted and directed such that the injected fluid initially obtains a flow direction following tangentially the inner circumference of the cylinder chamber thereby making the flow path spiral-shaped as the piston brings about an expansion of the volume of the first cylinder chamber. The advantage thereof is that the working fluid will then flow cyclonically inside the cylinder, and the parts of the fluid having the highest density will then be flung outward against the cylinder wall. This again may lead to increased heat exchange with the cylinder wall, the coolest parts of a fluid normally having the highest density, such as if the fluid is partly in liquid form.

The first cylinder chamber comprises mainly a first cylinder section, and on this are formed external flow channels wherein a heated thermo-fluid is circulating. The thermo-fluid transports heat from an external heat reservoir. During the expansion of the working fluid extra heat is supplied by the cylinder wall acting as a heat exchanger between the thermo-fluid at the outside of the cylinder and the working fluid on the inside. Depending on how efficient the heat exchange is, and the temperature level of the thermo-fluid, a spectrum of polytropic expansion processes may be achieved. In a case where no thermo-fluid is circulated, and therefore no heat is supplied to the working fluid, a near-adiabatic expansion process may be achieved provided the expansion occurs quickly enough. If enough heat is supplied to keep the working fluid temperature constant during the expansion, an isothermal expansion process is achieved. If even more heat and working fluid is supplied, an isobaric expansion may be achieved, wherein the pressure will be relatively constant throughout the expansion process. In an even more extreme example so much heat and working fluid may be supplied to the process that the pressure increases during the expansion, and a superbaric expansion process is achieved. Before the working fluid has come into contact with the first cylinder chamber, before or after the nozzle, but after the valve at the outlet of the heating course, there may in addition be fitted a heater supplying further heat to the fluid at the beginning of its expansion. In this manner the heat exchange in the first expansion process will not only be dependent on the heat exchange capacity of the first cylinder chamber.

The invention is not limited to a specific number of volume change/working chambers, but may generally comprise one or more work chambers, depending on how one chooses to implement the heat exchanger function. In a preferred embodiment the essential of the invention is that a transition in the heat exchange processes is present, proceeding from having a polytropic expansion (with heat supply) to having a near-adiabatic expansion (without particular heat supply), and where this may be solved with internal heat exchangers, as opposed to in internal combustion engines. In combustion engines, such as diesel engines, this is relatively simple to solve by stopping the fuel injection before the expansion is completed, and may thereby give the remaining part of the expansion process an adiabatic course, as no more heat than that given by the fuel combustion is supplied. The advantage of this is that at the same time as extra heat is supplied during the expansion, it is also obtained to utilise the residual heat that alternatively would have to be cooled away, thereby causing an undesired energy loss. This also corresponds to the solution in traditional steam engines, where the steam supply from the boiler is closed long before the piston (or pistons in a multi expansion engine) has reached full cylinder displacement. If a lot of heat is supplied during the whole of the expansion course, one will end up with a high residual pressure and a high residual heat, which may not be utilised for performing work, hence the loss.

The challenge and solution is to divide the expansion process into at least two steps, whereof the first step takes place with heat exchange with some sort of variant of a polytropic or mixed, polytropic process, while the second step takes place with little or no heat exchange. This may be solved in many ways.

In a very simple example, illustrated in FIG. 19, one may provide an internal heat exchanger in the cylinder enclosing only a part thereof. In this manner the portion of the heat exchanger surfaces relative to the total inner cylinder surface will decrease when the piston uncovers more and more of the cylinder walls during the expansion stroke. Then, when the working fluid expands, the volume will increase, the density decrease, and the portion of heat exchanger surface decrease, which will drive the process more and more in an adiabatic direction. In addition the surfaces within the cylinder not belonging to the internal heat exchanger may be thermally insulated, to further an even more adiabatic course, as it will counteract heat exchange in these areas further. If, in addition, expansion of a two-phase fluid is concerned, where the fluid at one stage or another passes from liquid to gas during the expansion, this will also entail a considerable reduction in heat transfer due to the gas phase having a lower heat transfer coefficient, which will contribute to push the process further in an adiabatic direction. In this way there may by use of one single cylinder be created a transition in the expansion process, where there will be a high initial heat transfer, while it will diminish considerably over time, to then approach adiabatic.

In a more preferred example, as shown in the FIGS. 6*a* and 7*a*, or in the FIGS. 17 and 18, the two processes may be separated by utilising expansion between separate cylinder chambers. In this way it is easier to limit the fluid contact against the heat exchanger surfaces during expansion, as one may choose to only have heat exchange in one cylinder chamber, or at least not in the last cylinder chamber, the fluid flowing in here not receiving further heat. Firstly the fluid in the first heated cylinder chamber is expanded, and thereafter the fluid expands further in the second, adiabatic cylinder chamber, as this has a greater displacement volume than the first. To achieve this, the two chambers must also be connected in a fluid-communicating way, the pistons must at least be out of phase, for example be synchronised with displacement opposite one another, and a valve (not shown in the figures) must provide for this happening at the right time. In such an example the first expansion process taking place in the first chamber will have the character of a polytropic or a mixed polytropic expansion, where a considerable amount of heat is supplied provided the heat exchanger is suitably designed. The second expansion process will be polytropic to start with, as most of the fluid is still in the first chamber having an internal heat exchanger, but as the fluid mass is transferred toward the chamber without a heat exchanger, the process will then also approach a more adiabatic course, as less and less heat may be supplied here. This example may be carried out with several variants of inter alia cylinder/piston assemblies, with inter alia both double-acting ones, as shown in FIG. 6*a*, and single-acting ones, as shown in FIG. 7*a*. In addition the time allowed for heat exchange with the fluid may be increased by using a cascade of several cylinders/pistons with and without heat exchangers, as suggested in FIGS. 17 and 18. The difference between the two is that FIG.

17 shows a double-acting cylinder for the polytropic expansion, while a single-acting cylinder has been chosen in FIG. 18. There are advantages and drawbacks in both solutions, particularly with respect to lubrication, friction and density, but this will not be discussed in greater detail here, as it is immaterial to the basic features of the invention.

In special cases, in which it is desirable to have for example a higher effect density, lower efficiency or both, it is possible to provide for heat exchange even in the final part of the expansion process. Exemplary embodiments are shown in the FIGS. 6*b* and 7*b*, where both the cylinder chambers are in thermal contact with heat exchangers. This may moreover also apply to the solution shown in FIG. 19, as the portion of the cylinder chamber being in contact with a heat exchanger at any time does not have an upper limitation and may in principle enclose nearly 100% of the cylinder volume.

Again, the T-s diagram in FIG. 16*b* gives an illustration of the thermodynamic result for a process according to the invention.

A polytropic process is approximately described by the relation $PV^n$=constant, in which P is the pressure, V is the volume and n is the characteristic polytropic index of the process. Further, working fluids have an adiabatic index, gamma ($\gamma$), and this varies for different fluids. When $n=\gamma$ the process is defined as adiabatic. Further, if n=1, the process is defined as isothermal where the temperature is constant and the nRT term in the ideal gas equation PV=nRT is consequently constant. Further, n=0 defines an isobaric process wherein the pressure is constant. In the same way, $n<0$ may be defined as a superbaric process, as the pressure then must increase during the expansion. The expansion process in the lower cylinder chamber may then be generalised and be described as a polytropic process approximately following $PV^n$ where $n<\gamma$, as a heat exchange occurs between the first cylinder chamber and the fluid.

When the piston has reached its top position (TDC—Top Dead Centre) (or bottom position (BDC—Bottom Dead Centre) in a two-cylinder design), the volume in the first cylinder chamber has reached its maximum. At this point the valve in the heat engine bypass is opened, and the expansion may continue from the first cylinder chamber via the bypass and into the second cylinder chamber, this chamber acting as a second expander. The second cylinder chamber is fully or partly thermally insulated from the rest of the heat engine so that the fluid flowing in here undergoes a near-adiabatic expansion. In an alternative embodiment of the engine it may be considered to be favourable having further heat supply in the second cylinder chamber, and then surfaces in this chamber may have a function as heat exchangers in the same way as in the first one. At the same time as the working fluid flows into the second cylinder chamber, a corresponding amount will also flow out of the first chamber. When this happens, the total volume of the fluid increases, and because the first chamber is heated, the portion of the fluid still present in this chamber will be supplied with even more heat before it flows out via the bypass. As the working area of the piston in the first cylinder chamber in the single-cylinder design is defined between the radial inner wall of the cylinder and the radial outer wall of the piston stem, the working area of the piston in the second cylinder chamber will be considerably larger because the piston stem takes up a portion of the cross-sectional area in the first chamber. Thus a net force on the piston in a direction toward the first chamber is achieved throughout this expansion process. In a two-cylinder design of the heat engine this will be achieved by the second cylinder having a greater displacement volume than the first.

During the expansion process from the first to the second cylinder chamber, when the second cylinder chamber is not in contact with a heat exchanger, the working fluid undergoes a polytropic process, which normally starts non-adiabatic, and ends near-adiabatic. It must be added that in a special case, as with the expansion in the first chamber, the expansion in the second chamber will also be able to start near-adiabatic. If the expansion in the first chamber is adiabatic, the further expansion in the second chamber will also be adiabatic.

Depending on how much fluid is injected, and also the degree of heat exchange in the first cylinder chamber, it will be correct to define the start of the expansion from the first to the second cylinder chamber as a polytropic process wherein $n<\gamma$, as a heat exchange occurs here between the first cylinder chamber and the fluid. It will further be correct to define the end of the expansion by $n\approx\gamma$, if heat exchange does not take place in the second expansion chamber, and then accordingly may be counted as adiabatic. This expansion process may then be generalised and described as a process approximately following $PV^n$, having $n<\gamma$ at the start, and approaching $n=\gamma$ toward the end. In an embodiment where there is heat supply in the second expansion chamber, the whole of this expansion process may be defined by $n<\gamma$.

In one single-cylinder embodiment the fluid injection may only be done when the piston is on its way upward, that is to say that the injection is concluded before the fluid is expanded further in the second chamber as the piston is on its way down again. In another embodiment the fluid injection may continue while there is expansion from the first into the second chamber. The drawback with this embodiment is that if the process is not allowed to end more or less adiabatic, there may be available some usable residual heat and residual pressure (according to the second law of thermodynamics) which is not used to do work. This must then be removed by the cooling process at the final step of the cycle. Because the recuperator can never "recirculate" 100% of the available residual heat, the residual, usable heat after the recuperator segments must be cooled away, and the energy disappears out as loss in one or more coolers. Still, it may be an advantage to have this possibility, as it may then be possible to increase the heat supply to the process over a given time. This may be useful if there is a need for extra power output for a limited amount of time, such as at increased load on the engine, but then at the sacrifice of efficiency. These aspects are also valid for a two-cylinder variant.

In a single-cylinder embodiment, after finished expansion in the second cylinder chamber, nearly the whole amount of working fluid will have been moved from the first cylinder chamber to the second cylinder chamber. At this point the piston has returned to the bottom position (BDC—Bottom Dead Centre) again. Around this point the heat engine outlet valve opens, and the working fluid may flow out into the cooling course for removal of residual heat, and therefore also residual pressure. The cooling course may consist of at least one recuperator and at least one cooler. The piston will further move upward again, and at the same time as a new, non-adiabatic expansion may take place in the first cylinder chamber, the piston will compress, or more correctly expel, the residual fluid that is in the second cylinder chamber, into the cooling course. Depending on the size of the volume of the cooling course, this process may be described in different ways. In a period where the piston is close to the bottom position the volume change will be relatively little in relation to the position change of the crankshaft, and it may be said that for a given time there is an isovolumetric cooling process, right up to the point when the piston has moved far enough out of the bottom position and the volume in the second cylinder chamber begins to change appreciably. When this occurs, one may no longer look upon the cooling process as isovolumetric. Depending on the capacity of the cooling course this part of the cooling process may be characterised as isothermal or isobaric compression, as the piston will displace the fluid out from the second cylinder and into the cooling course. When all the fluid is displaced out of the cylinder and into the cooling course, the heat engine outlet valve is again closed, and the fluid, now nearly completely displaced into the cooling course, may be cooled further at constant volume. Based on this the cooling process may be characterised by several combinations of different sub-processes, where the sub-processes again may be characterised as isovolumetric cooling, isobaric cooling or compression, isothermal compression which is also a form of cooling, or more generally non-adiabatic compression.

After concluded cooling the working fluid will be back in liquid form. At the cooling course outlet the liquid may flow into a tank, equivalent to an expansion tank for cooling water in various vehicles, for example. This will act as a liquid buffer and provides for there always to be enough working fluid available for the engine, which will be particularly important if the load on the engine varies and the needed flow rate of working fluid varies.

When the working fluid is completely cooled and back in liquid form, it may then be reused in a next cycle, as in closed-loop Rankine turbines. The present invention also comprises a closed working-fluid circuit.

It is to be noted that the engine may complete several mechanical cycles before the working fluid has completed a full thermodynamic cycle. This is the case because this engine always operates with simultaneous cycle processes as opposed to for example a four-stroke Otto engine. For example, by expansion in the first cylinder chamber, there will always be fluid expelled from the upper cylinder chamber and into the cooling course. Likewise, fluid will be injected into the heating course at the same time as fluid is being injected and expanded in the first cylinder chamber.

As an alternative expander a turbine solution may be used instead of the described piston solution, and for this to be able to add extra heat to the fluid during the expansion a turbine solution having a heat-exchanging stator, rotor and/or other internal components may be formed.

If there is a need for lubricating the engine, the working fluid may, in one embodiment, be mixed with a lubricant, and the transport of the working fluid will then also provide for transport of the lubricant around in the engine. In other cases lubricant may be supplied in different places by means of lubricating channels, as inter alia in most combustion engines. The engine may also be made of self-lubricating materials, not needing lubricant. This is known from various types of heat engines.

Further, in another embodiment the case may be that there is not a need for complete sealing between the cylinder and the crank housing/motor housing, and that a small amount of working fluid and possibly mixed with lubricant then is allowed to leak into other portions of the engine. This presupposes that it has been taken into consideration that the engine must be able to handle leaks, by a system being arranged that will counteract accumulation of working fluid in various parts of the engine. An advantage of making the engine like this is that any lubricant mixed into the working fluid may also function as a lubricant for the crankshaft bearings and also other components outside the cylinder, almost like in a 2-stroke internal combustion engine.

In the thermodynamic cycle and heat engine that this invention deals with, a characteristic composition of sequential thermodynamic processes is provided. The cycle and its sequential processes may be generalised and summed up in the following manner:

1. Adiabatic compression
2. Heat supply
3. A first polytropic expansion in a first expansion chamber, where $n<\gamma$
4. A second polytropic expansion from the first to a second expansion chamber where $n<\gamma$, or where the expansion starts with $n<\gamma$ and ends near-adiabatic is ($n\approx\gamma$)
5. Cooling In a first aspect, the invention relates more specifically to a method for heat exchange in and work exchange with a working fluid in a heat engine, or a heat pump if the method and its sub-processes are substantially reversed, wherein a thermodynamic cycle for the working fluid is approximately described through the polytropic relation $PV^n$=constant, where P is the pressure, V is the volume and n is the polytropic index of the working fluid having the adiabatic index gamma ($\gamma$), and wherein the engine consists of at least one working mechanism provided with a first and at least a second volume change chamber, characterised by the method at least comprising the following steps in sequence:

a) in a first volume change process, to carry out a first polytropic volume change of the working fluid in a first volume change chamber, where $n<\gamma$, and b) in a second volume change process, to carry out at least one second near-adiabatic or polytropic volume change of the working fluid, from a first to a second volume change chamber, where $n<\gamma$, or where a volume change starts with $n<\gamma$ and ends near-adiabatic ($n\approx\gamma$).

The method may comprise the following steps in sequence:

in a first process, to carry out an adiabatic volume change of the working fluid;

in a second process, to exchange heat with the working fluid;

in a third process, to carry out the first volume change process according to step a) above;

in a fourth process, to carry out the second volume change process according to step b) above; and in a fifth process, to exchange heat with the working fluid, where the heat flow direction is the opposite of the heat flow direction in the second process.

The method may comprise the following steps in sequence:

in a first process, to carry out an adiabatic compression of the working fluid;

in a second process, to supply heat to the working fluid;

in a third process, to carry out the first volume change process according to step a) above, where the volume change process comprises expansion;

in a fourth process, to carry out the second volume change process according to step b) above, where the volume change process(es) comprise(s) expansion; and in a fifth process, to cool the working fluid.

The method may more specifically comprise the following steps in sequence:

the first process involves pumping the working fluid from low to high pressure by means of an injection unit;

the second process involves supplying heat to the working fluid in a heating course placed externally to the volume change chambers;

the third process involves injecting and expanding the working fluid in the first volume change chamber and simultaneously supplying heat to the fluid from at least a heat exchanger in thermal contact with the first volume change chamber;

the fourth process at least involves expanding the to working fluid further from the first to the second volume change chamber via a working-fluid bypass; and the fifth process involves cooling the working fluid in a cooling course arranged externally to the expansion chambers.

The fourth process may more specifically involve expanding the working fluid further from the first to the second volume change chamber via a working-fluid bypass.

The fourth process may more specifically involve, in a first step, expanding the working fluid further from the first to the second volume change chamber via a working-fluid bypass, and, in a second step, expanding the working fluid further from the second volume change chamber to a third volume change chamber via a second working-fluid bypass.

The fourth process may further involve supplying further heat to the whole or parts of the working fluid from at least a heat exchanger in thermal contact with the first volume change chamber.

The fourth process may further involve supplying further heat to the whole or parts of the working fluid from at least one heat exchanger in thermal contact with the second volume change chamber.

The working fluid may alternate between the liquid form and gaseous form.

In the third process, the working fluid may initially be in the liquid form, as it is injected into the first volume change chamber at a sufficiently high pressure, so that the liquid form is maintained during the injection operation.

The working fluid may be in the liquid form in the first process; in the liquid form in the second process; completely or partly supercritical in the second process; completely or n partly in the gaseous form in the third process; substantially under vaporisation in the third process; possibly under further vaporisation in the fourth process; and substantially under condensation in the fifth process.

In a second aspect, the invention relates more specifically to a heat engine arrangement, or a heat pump arrangement if the arrangement and its sub-components are substantially arranged for reversed functions, having at least one working mechanism provided with a first volume change chamber and at least a second volume change chamber with appurtenant displacement mechanism(s), wherein at least one heat exchanger is in thermal contact with and encloses or is enclosed by the at least first volume change chamber, the volume change chambers being connected in succession in a fluid-communicating manner through at least one working-fluid bypass, the first volume change chamber having a working-fluid inlet and the last volume change chamber having a working-fluid outlet, characterised by the working-fluid inlet, the working-fluid outlet and the at least one working-fluid bypass being provided with valves which are synchronised in order to maintain a sequential working-fluid flow in succession from the first volume change chamber and through the at least second volume change chamber, the working fluid being carried sequentially through the volume change chambers in a direction of flow from the working-fluid inlet to the working-fluid outlet.

The volume change chambers may successively exhibit increasing or decreasing volumes.

The volume change chambers may be arranged to have a function as expansion chambers.

The working-fluid bypass may be closable by means of at least one bypass valve.

A fluid passage between the volume change chambers and respective bypass end portions may be maintained in all of the working positions of the displacement mechanism(s) during the displacement of the working fluid between the volume change chambers.

The volume change chambers may together be arranged to be able carry out a volume change process of a working fluid, so that the working fluid may be displaced nearly completely from the first to the second volume change chamber and so further in that the displacement mechanism(s) of the volume change chambers are mechanically synchronised.

The mechanical synchronisation may in an operating condition maintain displacement between the different volume change chambers having sequentially opposite signs, so that the volume of a first volume change chamber will increase when the volume of a second chamber decreases and vice versa.

BRIEF DESCRIPTION OF THE DRAWINGS

In what follows is described an example of a preferred embodiment illustrated in the accompanying drawings, wherein.

DETAILED DESCRIPTION OF THE DRAWINGS

Figure 15:
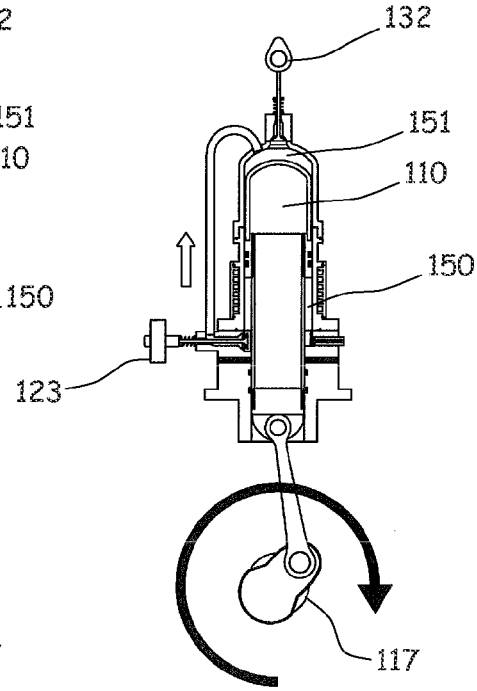
FIG. 15 shows a side view of the engine at expansion of working fluid from the lower to the upper cylinder chamber.
Figure 16A:
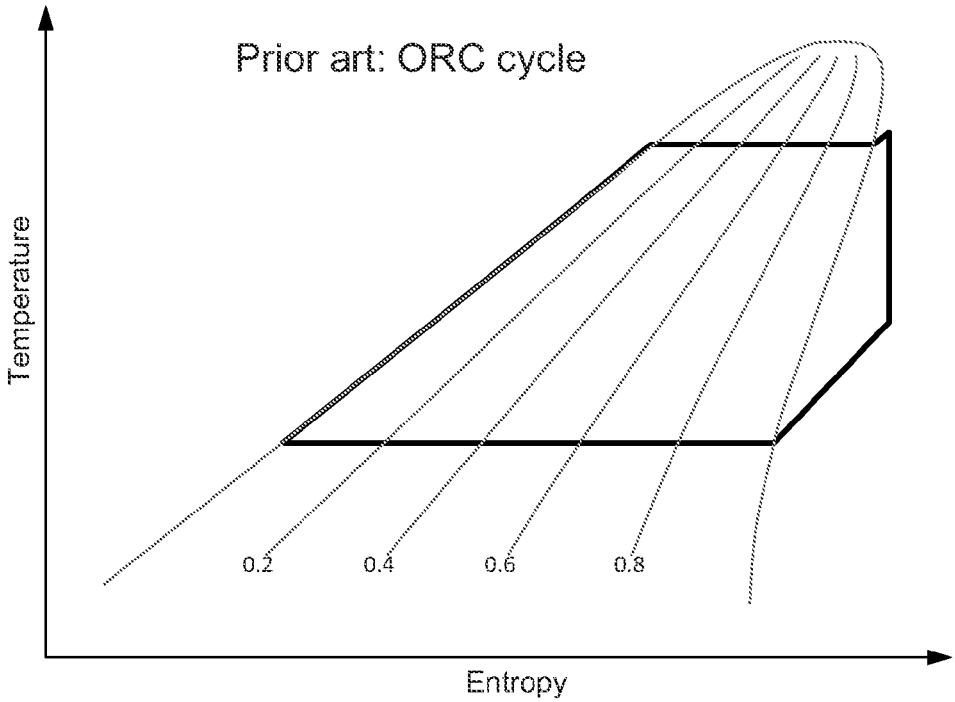
FIG. 16*a* shows a T-s diagram (temperature-entropy-diagram) according to prior art, namely for the idealised ORC cycle.
Figure 16B:
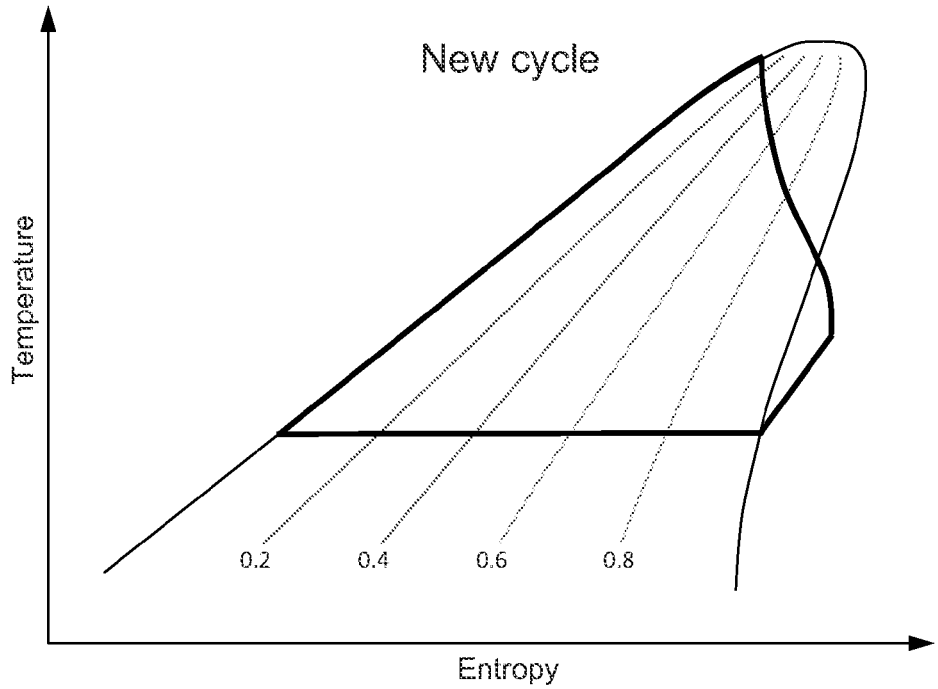
FIG. 16*b* shows a T-s diagram for the thermodynamic cycle as described in the invention.

In the introductory description of the thermodynamic cycle as it is shown in the FIGS. 1-4, and in the FIG. 16*b*, reference is made to elements in a heat engine as it is shown in the FIGS. 6-15, the engine elements being identified by reference numerals shown in one or more of the FIGS. 6-15.

Figure 1:
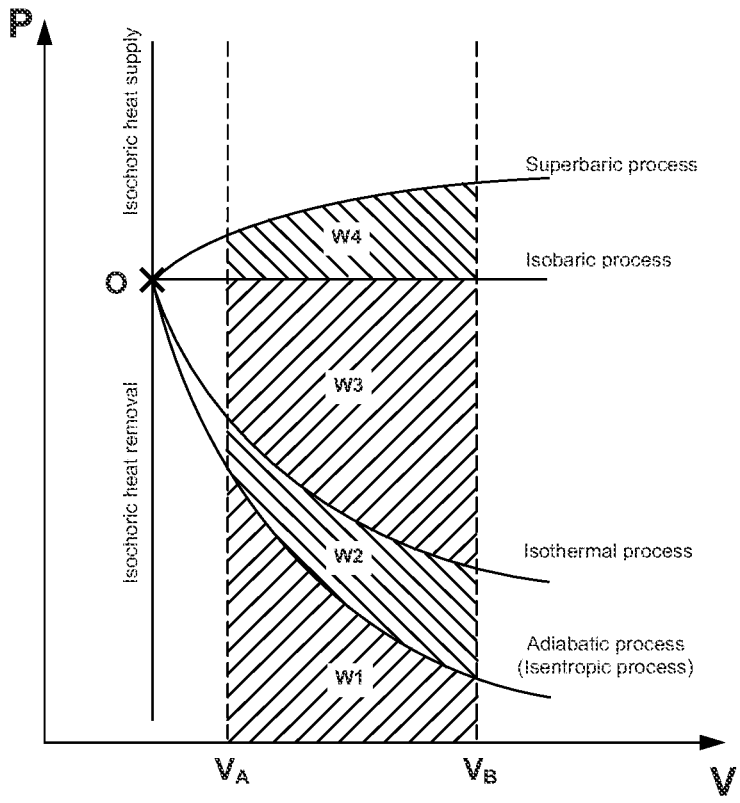
FIG. 1 shows a P-V diagram illustrating the difference in work done in different polytropic processes.

The thermodynamic cycle is described through the thermodynamic processes:

1. Adiabatic compression
2. Heat supply
3. A first polytropic expansion in a first expansion chamber, wherein $n<\gamma$
4. A second polytropic expansion from the first to a second expansion chamber where $n<\gamma$, or where the expansion starts with $n<\gamma$ and ends near-adiabatic ($n\approx\gamma$)
5. Cooling FIG. 1 shows a generalised polytropic expansion process between two volumes $V_A$ and $V_B$, where the work and the difference in work between the various pure processes (adiabatic, isothermal, isobaric et cetera) is shown as W1, W2, W3 et cetera. In addition isovolumetric heat exchange is shown as reference, illustrated by the vertical line. Here is assumed a thermodynamic system with a starting condition indicated by a cross O, and the further expansion course is shown by the various polytropic processes. It is seen from the diagram that work done varies considerably depending on what sort of process is active. An isothermal process will give considerably greater work than an adiabatic process. An isobaric process will further give a still higher work and so on. The diagram gives a good visual comparison of work done between the various processes.

Figure 2:
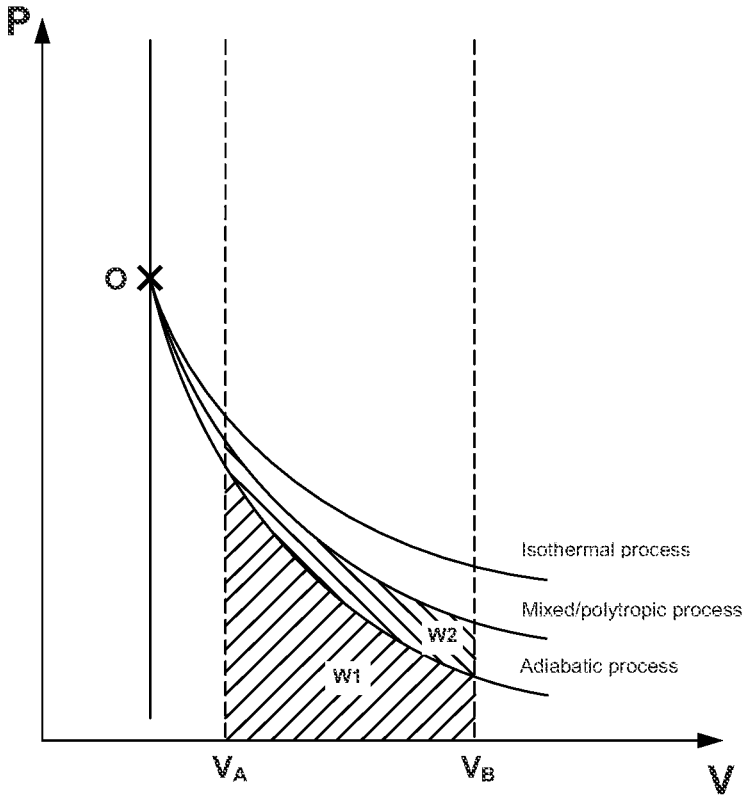
FIG. 2 shows a P-V diagram illustrating the difference in work done in selected polytropic processes.

FIG. 2 shows work done for a variable, polytropic process starting isothermally and ending near-adiabatic, like in this invention. It can be seen that the difference, W2, between the mixed and the adiabatic process represents a considerable increase in work. The practical result of this is that by adding some extra heat during the expansion process, but not enough for it to be purely isothermal, the effect through-flow in the cycle may be increased at the same volume change.

Figure 3A:
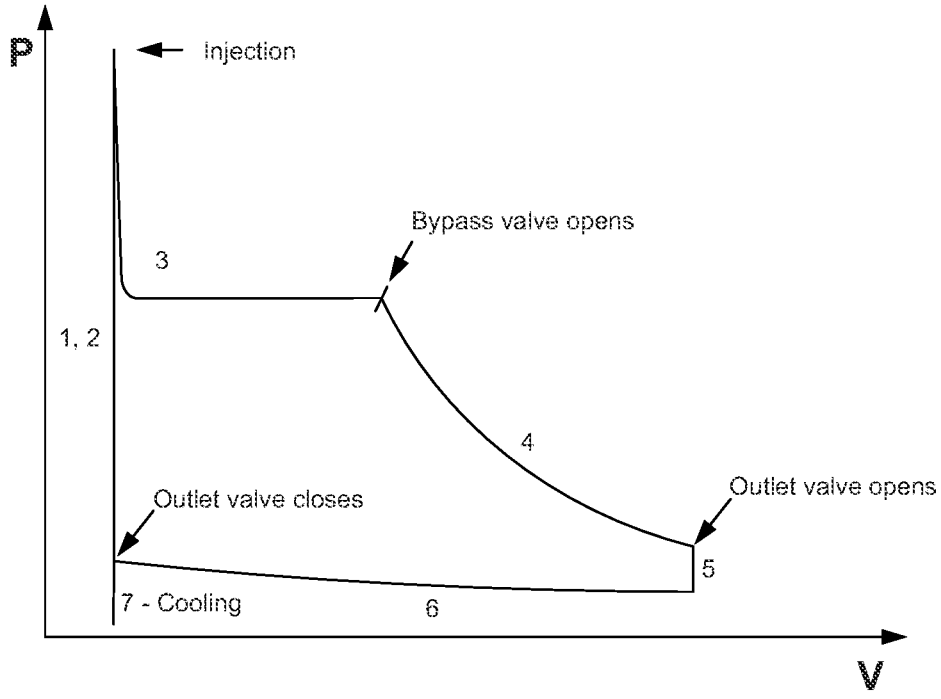
FIG. 3*a* shows a P-V diagram showing an extreme variant of the thermodynamic cycle as described in the invention, where the first expansion process substantially takes place isobarically.
Figure 3B:
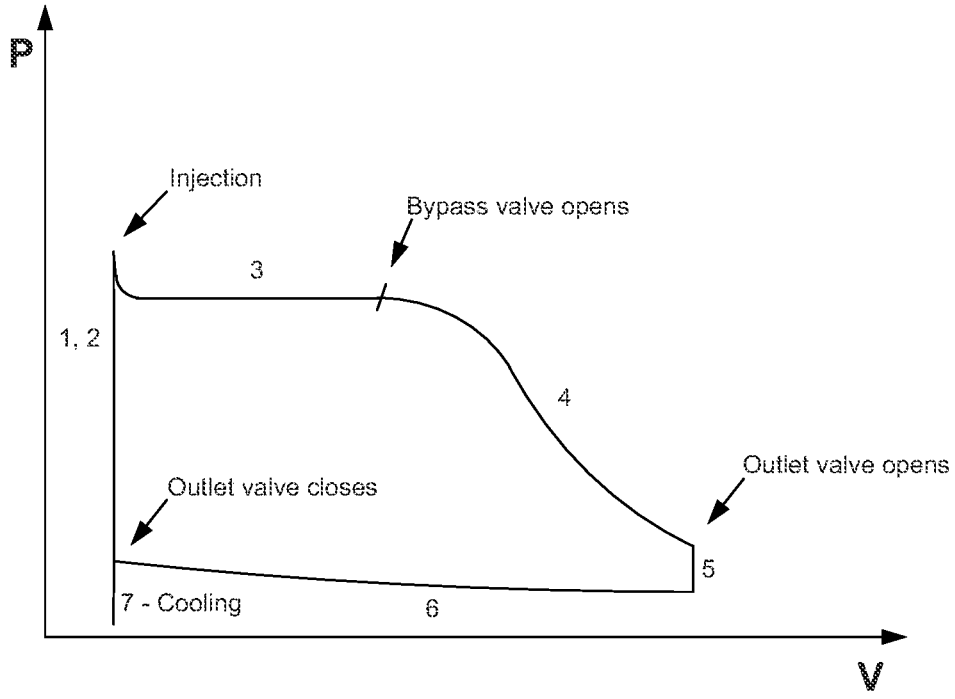
FIG. 3*b* shows a P-V diagram of the thermodynamic cycle as described in the invention, where the expansion processes take place more close to a practical a embodiment of the engine, but where the first expansion process substantially takes place isobarically.
Figure 3C:
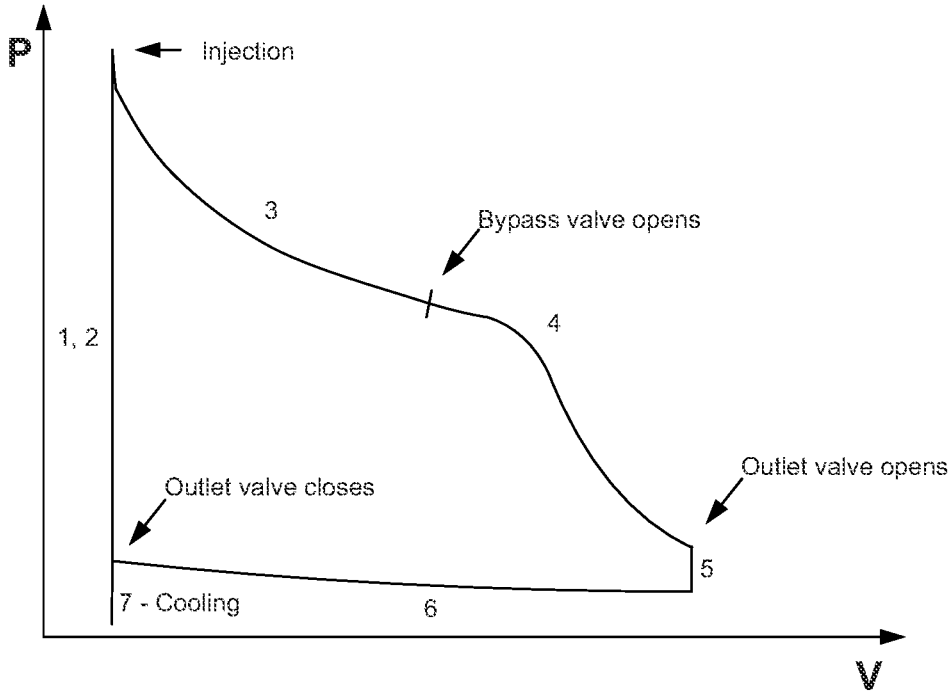
FIG. 3*c* shows a P-V diagram of the thermodynamic cycle as described in the invention, where the expansion processes in yet another practical embodiment of the engine is illustrated.

FIGS. 3*a*-3*c* show P-V diagrams illustrating the various steps in several variants of the thermodynamic cycle as described in the invention. Step 1 represents the adiabatic compression of a working fluid performed by an injection unit 2. This process will raise the working-fluid pressure up to a particular level. Step 2 constitutes further heat supply from at least one recuperator 32, 35 and at least one heater 33, respectively, in the system. This process may be implemented as isobaric, but it may also contribute to increasing the pressure depending on the design solution chosen. In step 3 a polytropic expansion according to $PV^n$=constant where $n<\gamma$ takes place, meaning that heat is being added through the expansion. This is illustrated in the FIGS. 3*a* and 3*b* by n=0, that is to say a near-isobaric process. In FIG. 3*c* it is shown as polytropic. In step 4 a variable polytropic expansion takes place, starting with n equal to the previous step, but ending near-adiabatic, where $n\approx\gamma$. Steps 3 and 4 will in any case be in accordance with the invention as it only takes into consideration the order of size of the polytropic index, n, and not the exact number. In an embodiment where also heat is supplied in the second expansion chamber, the process will finally satisfy $n<\gamma$, and the curves will then deviate somewhat from the illustrations. In step 5 a pressure drop takes place in that an outlet valve 131 opens and the working fluid is released into a cooling course 4, where in a given time it undergoes cooling at relatively constant volume. In step 6 a compression, that is to say an expulsion with cooling takes place, a process that for example may be between isothermal and isobaric, but shown here as near-isothermal, illustrated by the pressure increasing somewhat during compression, and the P-V diagram approaching an isotherm. In step 7 the outlet valve 131 is closed and the cooling continues under constant volume again. As a whole the cooling steps may in a given case be regarded as an isobaric cooling process, provided the cooling course 4 has a certain capacity and the processes take place quickly. The cooling process (process 5 above) in the cycle is thereby represented by the steps 5, 6 and 7 in the P-V diagram.

In addition it may be noted that at a working-fluid inlet 170, also called a nozzle, a choking process, also called a throttling process, may be assumed to take place. This process will then take place between the processes 2 and 3 in the cycle. This alternative process is not specified in the cycle, because it is not important for the description of the cycle as it does not have particular influence on the preceding or the succeeding processes. In a hypothetical case where the internal pressure in the heating process 2 is high relative to the given working pressure of the engine, the throttling process will be illustrated by a sharp drop in the pressure between the steps 2 and 3, as shown in the diagram. In a case where the injection pressure is set close to the chosen working pressure of the first expansion process, this pressure drop will not be so marked, as shown in the FIGS. 3*b* and 3*c*, and this part of the diagram will then be leveled off like in the illustrations.

Figure 4A:
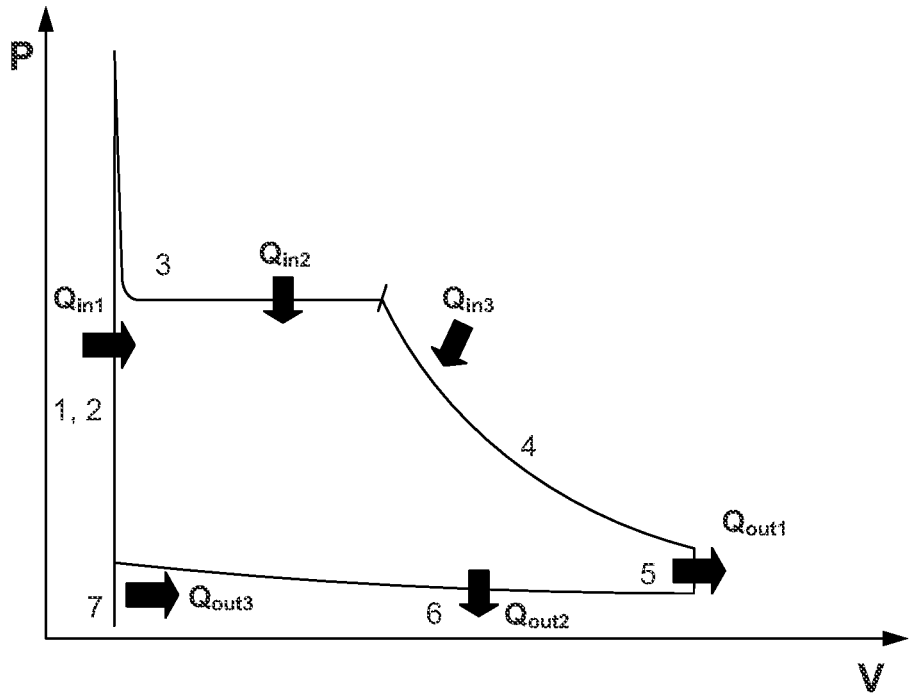
FIG. 4*a* shows a P-V diagram illustrating the heat flow in an extreme example of the thermodynamic cycle as described in the invention, where the first expansion process substantially takes place isobarically.
Figure 4B:
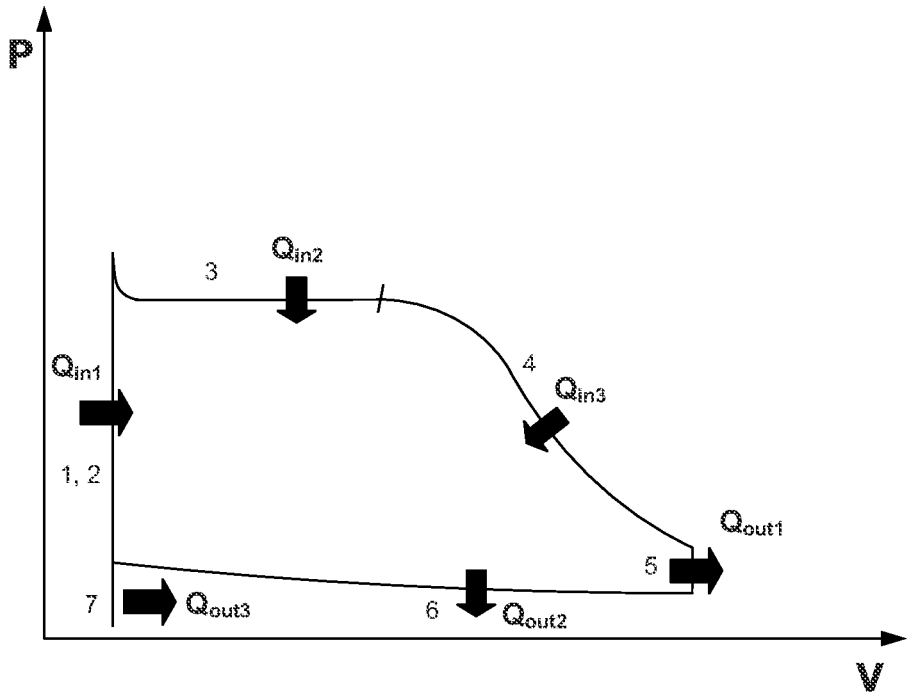
FIG. 4*b* shows a P-V diagram illustrating the heat flow in a more practical embodiment of the thermodynamic cycle as described in the invention, but where the first expansion process substantially takes place isobarically.
Figure 4C:
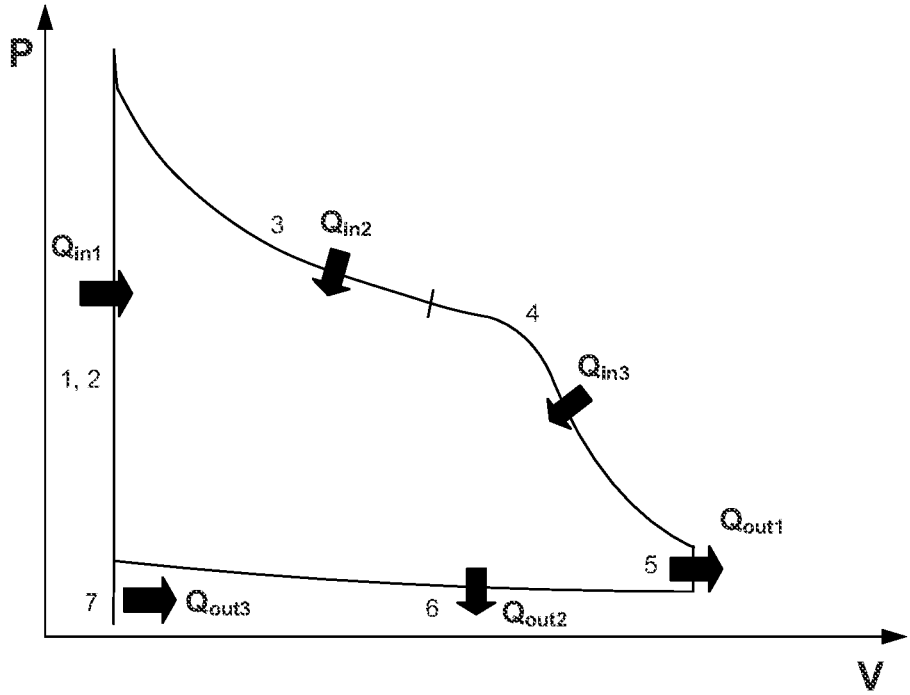
FIG. 4*c* shows a P-V diagram illustrating the heat flow in still another practical embodiment of the thermodynamic cycle as described in the invention.
Figure 5:
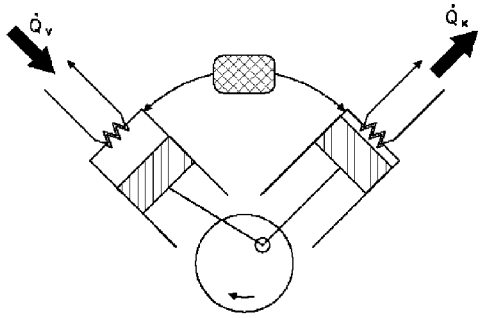
FIG. 5 shows the prior art, namely a basic assembly of a Stirling engine.

FIGS. 4*a* to 4*c* show different P-V diagrams with the various heat exchanging processes taking place in the cycle and the described heat engine. $Q_{in1}$ represents heat being supplied from one or more recuperators 32, 35 and/or one or more subsequent heater segments 33 (process 2 in the cycle). $Q_{in2}$ represents the heat supplied in the first non-adiabatic, alternatively polytropic expansion process (process 3 in the cycle), wherein heat is transferred to the working fluid in a first cylinder chamber 150 from the heat exchanger of a lower cylinder 102 (alternatively from the heat exchanger of a first cylinder 100*a* for a two-cylinder variant). $Q_{in3}$ further represents the heat supplied in the second non-adiabatic, alternatively variable polytropic, alternatively polytropic expansion process (process 4 in the cycle), wherein still more heat is supplied to the working fluid, which has not yet passed out of the first cylinder chamber 150, alternatively wherein further heat may be supplied in the second cylinder chamber 151 as the fluid flows in and is expanded further here. $Q_{out1}$ is heat removed in the cooling course 4 immediately after the outlet valve 131 has opened (process 5 in the cycle, step 5 in the diagram). $Q_{out2}$ is heat removed during the expulsion/compression step, (process 5 in the cycle, step 6 in the diagram) and $Q_{out3}$ is removal of the last residual heat in the cooling course 4 after the outlet valve 131 has been closed, and nearly all the remaining working fluid has been evacuated out here (process 5 in the cycle, step 7 in the diagram).

Figure 8:
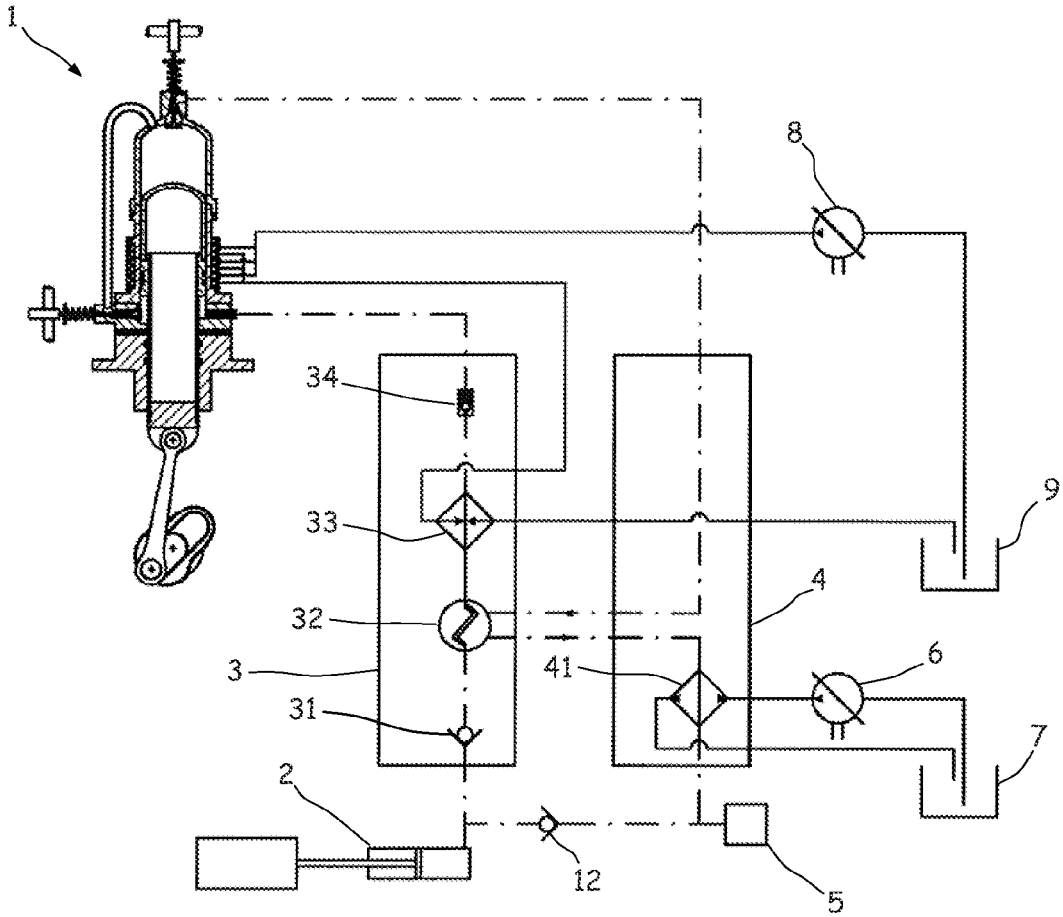
FIG. 8 shows an exemplary embodiment of the described heat engine according to the invention, where only a single heat reservoir is used.
Figure 9:
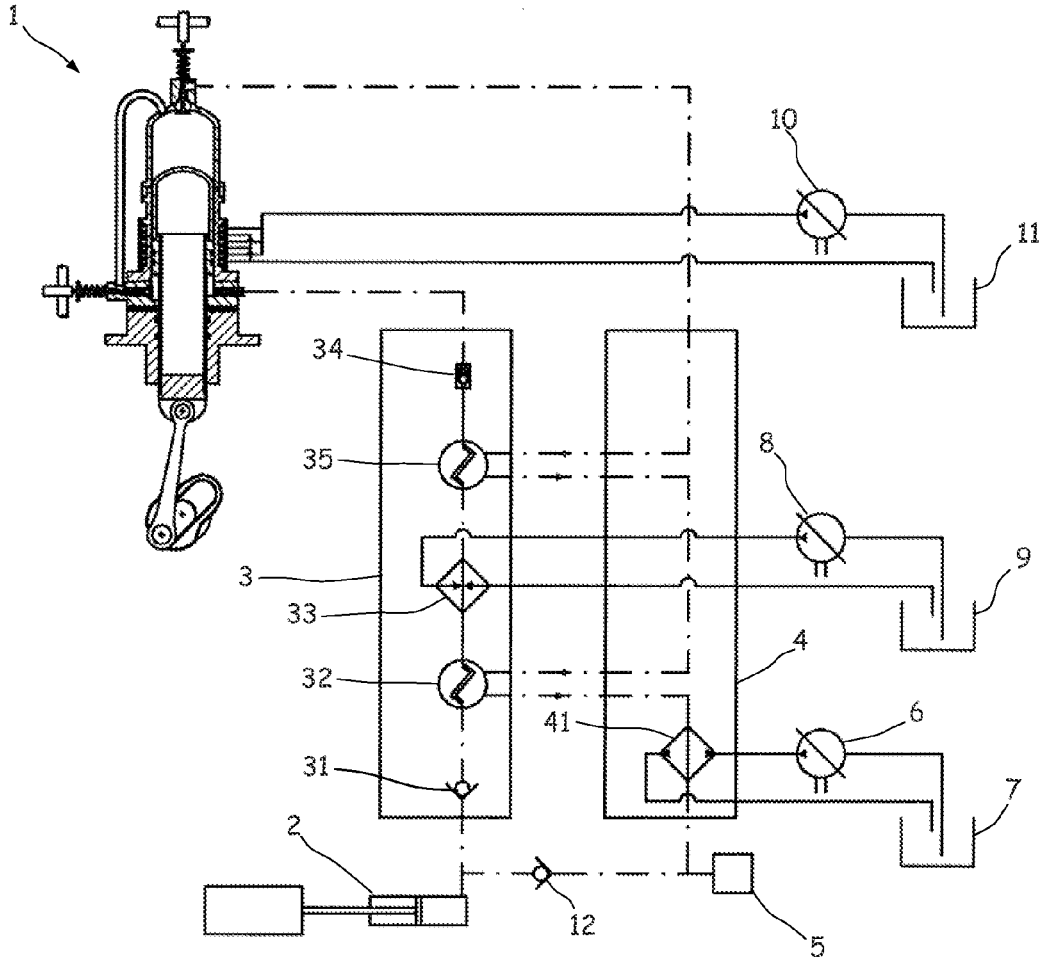
FIG. 9 shows an exemplary embodiment of the described heat engine according to the invention, where two heat reservoirs at different temperatures are used.

The heat engine consists of a main mechanism/working mechanism 1, also called an expander, with appurtenant external components and systems as an injection unit 2, also called a pump/compressor, a heating course 3, a cooling course 4, a liquid tank 5, a circulation pump 6 for cooling fluid, a cold reservoir 7, a first and a second circulation pump 8, 10 for heating fluid, a first and a second heat reservoir 9, 11 and a first non-return valve 12 preventing reversing of the fluid flow in to the injection unit 2. FIG. 8 shows an embodiment of the engine having only one heat reservoir 9, wherein a thermo-fluid may then be circulated from the reservoir 9 both to heat exchanger channels 162 in the lower cylinder 102, alternatively through a heat exchanger 260 if the second expansion chamber 151 is also to have heating, alternatively also through a heat exchanger 160 in the first cylinder 100*a* for a two-cylinder variant, and on through a heater segment 33 in the heating course 3 before it is returned to the reservoir 9 for reheating. FIG. 9 shows a second variant of the engine having a more extensive heat supply system, wherein two heat reservoirs 9, 11 are used instead of one, and wherein the first heat reservoir 9 is of a low-grade character and the second heat reservoir 11 is of a high-grade character in the sense that the high-grade reservoir 11 supplies heat at a considerably higher temperature than the low-grade reservoir 9.

The main mechanism 1 together with the injection unit 2, the heating course 3, the cooling course 4, the liquid tank 5, the circulation pumps 6, 8, 10, piping, hoses and a possible appurtenant control unit are the components that will normally be perceived as the actual heat engine. All the same, the heat engine cannot function without available heat and cold reservoirs, and they are therefore included as a n part of the total system.

The heating course 3 consists of a second non-return valve 31 at the inlet from the injection unit 2, followed by a first, possibly also a second, recuperator 32, 35, a heater 33 and finally a valve 34, which for example may be a choke valve or a pressure threshold valve such as a cycling valve.

Figure 6A:
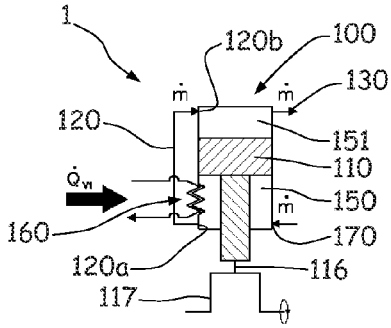
FIG. 6*a* shows a basic exemplary embodiment of the working mechanism (the expander) of the invention having a double-acting cylinder and a heat exchanger in thermal contact with a first expansion chamber.
Figure 6B:
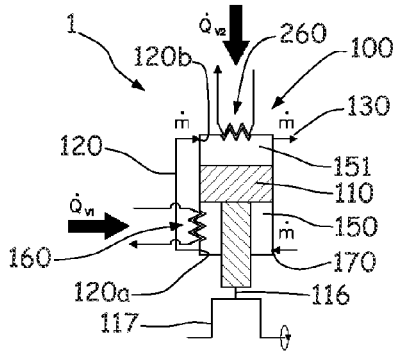
FIG. 6*b* shows a basic exemplary embodiment of the working mechanism of the invention having a double-acting cylinder and a heat exchanger in thermal contact with the first expansion chamber, and a heat exchanger in thermal contact with the second expansion chamber.
Figure 7A:
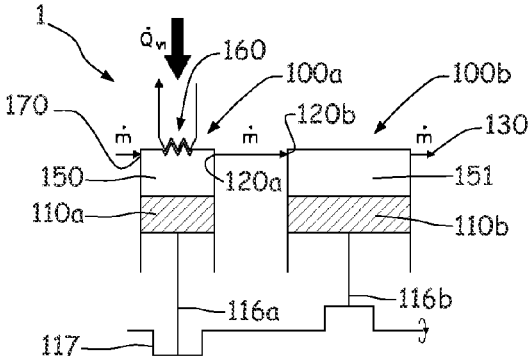
FIG. 7*a* shows a basic exemplary embodiment of the working mechanism of the invention in the form of a two-cylinder variant having a heat exchanger in thermal contact with the first expansion chamber.
Figure 7B:
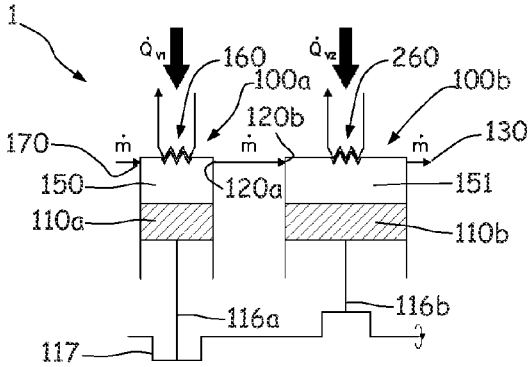
FIG. 7*b* shows a basic exemplary embodiment of the working mechanism of the invention in the form of a two-cylinder variant having a heat exchanger in thermal contact with the first expansion chamber, and a heat exchanger in thermal contact with the second expansion chamber.
Figure 10:
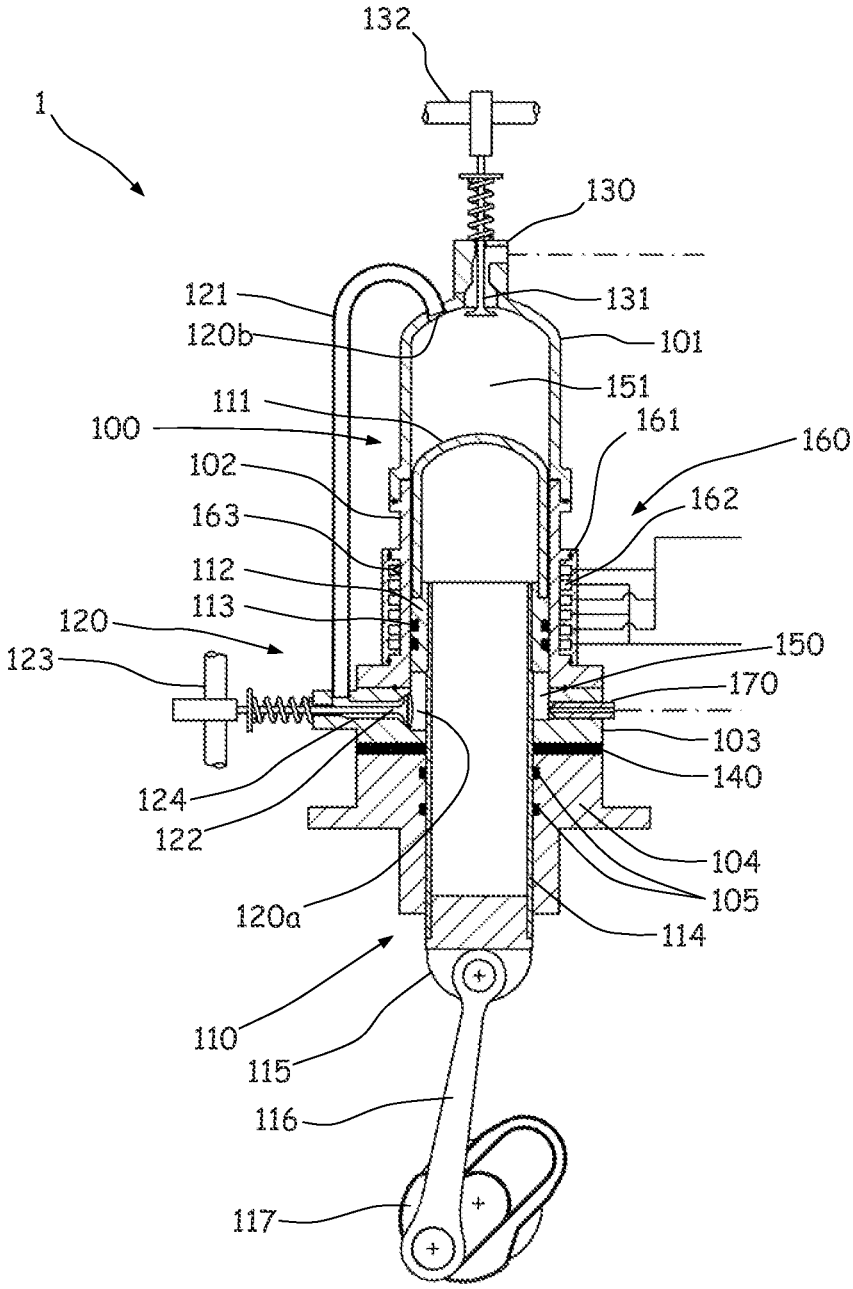
FIG. 10 shows the working mechanism of the heat engine without a crank/motor housing.
Figure 11:
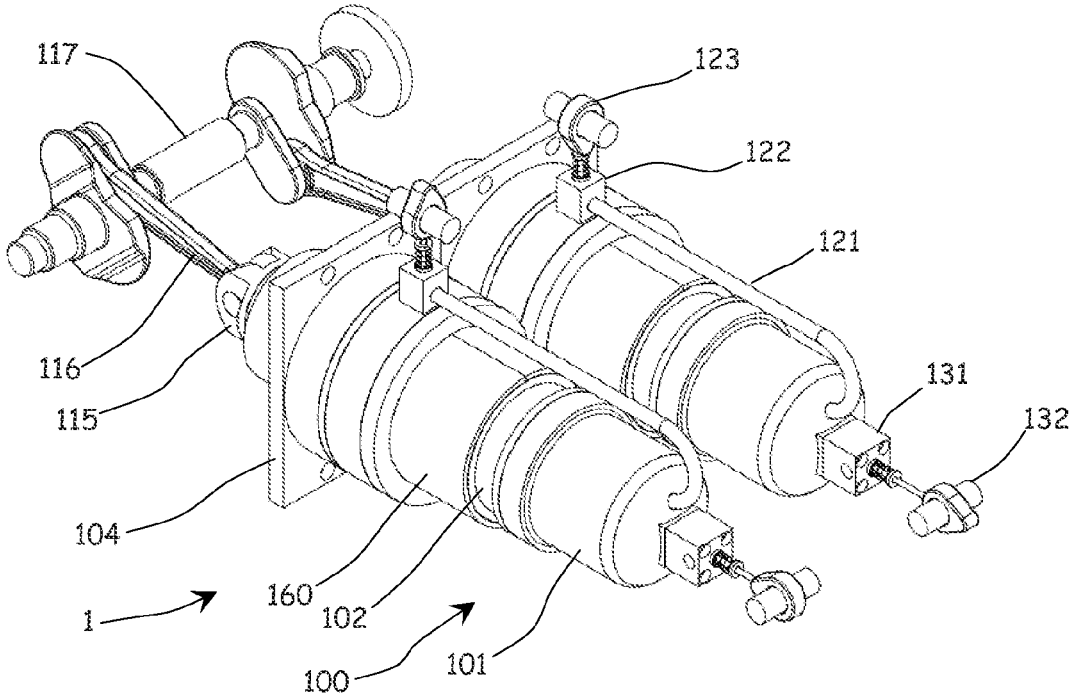
FIG. 11 shows in perspective a representation of the heat engine without a crank/motor housing.
Figure 12:
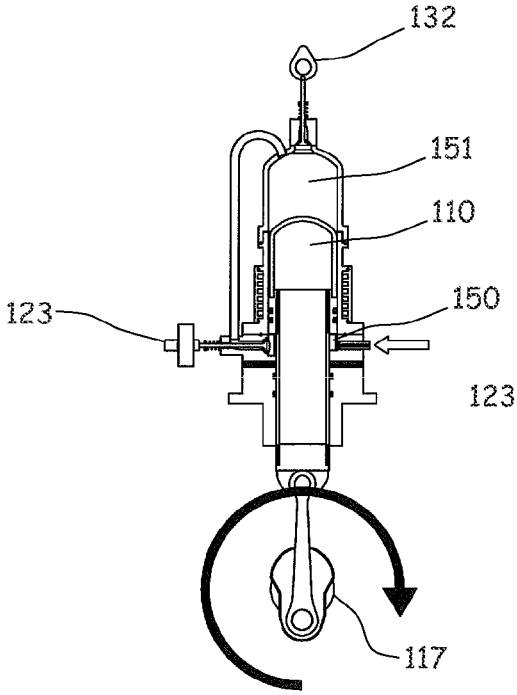
FIG. 12 shows a side view of the engine at the bottom position of the piston.
Figure 13:
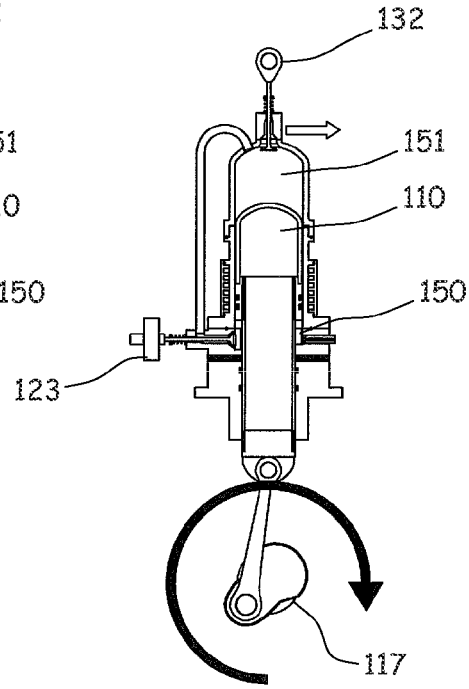
FIG. 13 shows a side view of the engine at expansion in the first (lower) cylinder chamber and also expulsion in the second (upper) cylinder chamber.
Figure 14:
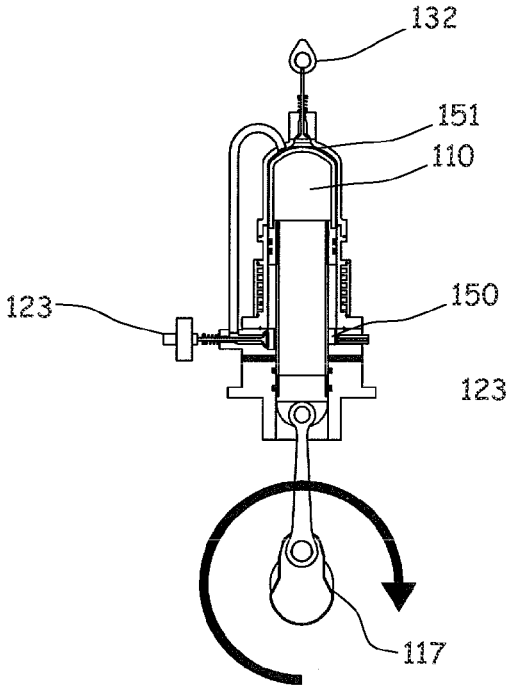
FIG. 14 shows a side view of the engine at the top position of the piston.

In the FIGS. 6*a* and 6*b* are shown a simplified principle diagram for the working mechanism of the engine with and without a heat exchanger 260 in the second expansion chamber 151. The FIGS. 7*a* and 7*b* show a corresponding principle diagram for a two-cylinder variant of the engine. It should be noted that details like seals and valves are not shown for simplicity, but it is to be understood that they are present. FIG. 10 shows, on the other hand, one exemplary embodiment of the engine where most of the details are shown. In what follows, references are made inter alia to the FIGS. 6*a*, 6*b*, 7*a*, 7*b* and 10. The main mechanism consists of easily recognisable main parts such as a cylinder assembly 100, a piston assembly 110 with seals 113 and a piston stem 114, an adapter 115 with a bearing functioning as an interface between the piston stem 114 and a connecting rod 116, a crankshaft 117, bypass and outlet valves 122, 131 with valve actuators 123, 132, shown here as cam shafts, a bypass line 121, a thermally insulating seal 140, hereinafter also called a thermo-seal, and also other common components and designs such as bolts, threaded holes, bearings, seals, lubricating channels et cetera that a person skilled in the art will find necessary for the construction. Engine housing/crankcase is not shown because it has no relevance to the invention, but it is all the same assumed that adequate regard is had to the engine housing to take care of tightness, lubrication of the crankshaft 117, bearings, fastenings and so on.

In an embodiment of the heat engine not shown, a small amount of lubricating oil is mixed into the working fluid, rather like in a 2-stroke engine. If a little of the oily working fluid is given the opportunity to leak from the cylinder 100 down into the crankcase, lubrication of the crankshaft 117 will be achieved, just like in a 2-stroke engine, and the problems by leaks down here are avoided, as a small leak will not make a problem, and having to use a separate lubricating medium for the crankshaft 117 bearings is also avoided, which would otherwise require a separate lubrication system. In that respect it is also assumed that there is a system able to catch the fluid leaking down into the crankcase, so that it may be circulated back to a possible reservoir for filtering and other measures that a person skilled in the art will consider necessary to ensure the integrity of the working fluid and also the lubricating oil, if any.

In the simplest case, the cylinder assembly 100 may consist of a simple machined component, but due to a need for thermal insulation between the various sections of the cylinder 100 and also inclusion of other components in the assembly, it will be more practical to make use of an assembly consisting of individual, more specialised components. In the described embodiment of this invention the cylinder assembly consists of three main components defined as a top cylinder 101, a bottom cylinder 102 and a valve block 103. The top cylinder 101 is also called the upper cylinder and the bottom cylinder 102 is called the lower cylinder. The cylinder assembly 100 is further attached to a sealing block 104 shown here provided with grooves with seals 105 fitted to counteract leaking of working fluid in the engine. The sealing block 104 has a preferably cylindrical, leak-tight passage for the piston stem 114. A thermo-seal 140 is installed between the cylinder assembly 100 and the sealing block 104. This has the function of limiting direct heat leakage to the lower part of the engine and mainly to the engine's crankcase/engine housing, which is not shown in the drawings. The top cylinder 101 may be made of various materials, both metallic and non-metallic. In one embodiment it may be made of aluminum or a plastic material such as PEEK, which is a strong material with good thermal-insulation properties. In another embodiment it may be made of a material with good thermal conductivity, which is then coated with a material promoting thermal insulation.

The bottom cylinder 102 is made of a material with good heat-conductor properties. It may be made of aluminum, for example. It may then be advantageous to coat the inner part of the cylinder 100 which is in contact with the piston 110 with a strong material that will work as a good sliding surface against this. This could be a coating of chromium or a carbide material, for example. This is known in existing internal combustion engines and compressors, among other things. The bottom part of the cylinder 100 is not to be in direct sliding contact with the piston 110. The piston 110 may for example be formed in such a way that a bottom part has a slightly smaller diameter than an upper part, for example only a few hundredths of a millimetre smaller, but still enough for no contact to be created with the cylinder 100. It is thereby possible to provide turbulence-promoting shapes or other shapes promoting heat exchange in the bottom part of the bottom cylinder 102, so that a working fluid which is to be heat-exchanging with this is supplied with heat in the most efficient manner possible. The turbulence-promoting designs may in a simple case be made by this part of the cylinder 100 being sand-blasted so that roughness is created. Further, an outer part of the bottom cylinder 102 is formed with channels 162 and also fitted with a sealing casing 161, which together form a heat exchanger 160 for a heat-exchanging fluid, a so-called thermo-fluid. The thermo-fluid will then give off heat to the bottom cylinder 102, which in turn may give off heat to the working fluid in the lower cylinder chamber 150. The channels 162 are provided with turbulence-promoting means 163, for example in the form of elevations in the channel walls, shown schematically here.

The valve block 103 constitutes an extension of the lower cylinder chamber 102, and here room has been made for at least one valve 122, a bypass channel 124, and a working-fluid inlet 170, which may be an injection nozzle. The valve block 103 may basically be the same physical component as the lower cylinder 102, but due to the advantage of being able to place the valve 122 and the nozzle 170 in a separate assembly, and also the advantages that this may give in maintenance at cetera, it is, in this example, implemented as a separate component/assembly. In the valve block 103 may be machined channels and grooves adapted for as optimum a fluid flow as possible and also minimal dead volume. The valve block 103 may further be made with separate courses for thermo-fluid, so that it, in the extension of the lower cylinder 102, may also function as a heat exchanger between a thermo-fluid and a working fluid in contact with it.

The piston assembly 110, also called the piston, consists of a piston head 111, a sliding piston 112, the seals 113, the piston stem 114 and the piston stem adapter 115. These are attached to each other by mans of known attachment methods. In addition to functioning as a power transmission between the working fluid and the engine, the piston 110 also functions as a common movable partition between the upper cylinder chamber 151 and the lower cylinder chamber 150. As the piston 110 may be thermally insulated between its upper and lower axial ends, the piston head 111 like the top cylinder 101 may be made of an insulating material, or it may be made of a material which in turn is coated with a layer of a different material having good insulating properties. The sliding piston 112 may also be made of various materials, but it must be suitable for being able to slide against the sliding surface of the cylinder 100. In this example the sliding piston 112 may be made of an aluminium alloy, as is often usual in internal combustion engines and other piston machines. The sliding piston 112 is made with one or more circular circumferential grooves for the seals 113, again like pistons in internal combustion engines. The piston assembly 110 consists further of the piston stem 114 which may be made of metal. This may have the shape of a pipe to minimise the mass and thus the weight. The stem 114 may also be coated with a layer of a high-strength material, so that it should be suitable for sliding against the internal surfaces in the sealing block 104, the sealing block 104 having a bore for the piston stem 114. On the end of the piston stem 114, the adapter 115 is fitted and its main function is to adapt the linear motion of the piston stem 114 to the rotating motion of the connecting rod 116 in a bearing fitted in the transition. The adapter 115 may in addition have a function as a seal for one axial end portion of the piston stem 114, enabling the whole of the piston assembly 110 to have a closed, inner volume. This volume may possibly be evacuated so that vacuum is achieved, which may give the piston assembly 110 an improved thermally insulating effect if desired.

The main function of the sealing block 104 is to serve as a passage for the piston stem 114 and also a seal, so that working fluid in the lower cylinder chamber 150 will not leak out of this. In one embodiment it is made with internal grooves which in turn are provided with seals 105 that the piston stem 114 will then slide against. In another embodiment the piston stem 114 is made with external grooves and seals (not shown), in the same way as the sliding piston 112, and the sealing block 104 passage will then be a continuous sliding surface as in a cylinder in a four-stroke Otto engine. The sealing block passage is then preferably cylindrical, without grooves for seals as in the first exemplary embodiment.

The linear motion of the piston 110 is in the end transferred to the crankshaft 117 that will achieve a rotating motion, like in an ordinary internal combustion engine, and the crankshaft 117 may be further connected to a work receiver (not shown) like an electric generator, so that the engine may generate work for energy production et cetera.

Between the first cylinder chamber 150 and the second cylinder chamber 151 is formed a bypass 120 in which the working fluid may pass. The bypass 120 starts in the bypass channel 124 in the valve block 103, goes on via the channel 121, which may be a metal pipe, and further into the top cylinder 101 where the bypass 120 (and the channel 121) outlet **120*b* is arranged in the second cylinder chamber 151. The bypass end portions 120*a*, 120*b* are arranged in such a way that they cannot be closed by the piston 110 during the movement of the piston 110 between its extreme positions in the cylinder assembly 100, but only by the bypass valve 122** being operated.

The bypass 120 constitutes a passage making it possible for the working fluid in the first cylinder chamber 150 to expand further into the second cylinder chamber 151, as this has a larger total volume and also a greater volume change during the movement of the piston 110 than the lower cylinder chamber 150. In other words, dV/ds is greater for the top cylinder 101 than for the bottom cylinder 102, dV being the volume change relative to the linear position change of the piston 110, represented by ds. The difference in volume is due to the piston stem 114 only being in the volume of the bottom cylinder 102, then displacing a substantial part thereof. Thereby the fully expanded volume of the top cylinder 101 will be given by the stroke and the total end area of the piston 110, whereas the volume of the bottom cylinder 102 will be given by the same stroke, but the piston area is here limited to the difference between the radial, internal cylinder area and the radial piston stem area.

In the simplest case, the injection nozzle 170 may be a pipe fitted in a fluid-tight manner in a machined hole in the valve block 103. It may further be mounted in such a way that the fluid flow direction out of it will be tangential relative to the inner wall of the lower cylinder chamber 150. This may contribute to improving the heat transfer rate as described above.

The mode of operation of the engine may be described as follows:

A working fluid is in the liquid tank 5 and is sucked into the injection unit 2 via the first non-return valve 12, and is pumped further into the heating course 3 via the second non-return valve 31. In the heating course 3 the working fluid passes first through the first recuperator 32 wherein it receives some of the residual heat from the completely expanded discharging working fluid from the working mechanism 1 of the heat engine. Further, the working fluid passes through the first heater 33, which receives heat from the first heat reservoir 9 in that the circulation pump 8 circulates a thermo-fluid between the heat reservoir 9 and the heater 33. Further, the fluid may in other exemplary embodiments, as shown in FIG. 9, receive more heat from the second recuperator 35, wherein residual heat at a higher temperature than in the first recuperator is transferred. The working fluid then flows through the valve 34 and is further injected via the nozzle 170 into the first cylinder chamber 150 as from when the piston 110 is in the bottom position (see FIG. 12).

In an exemplary embodiment not shown the working fluid flows through yet another heater (not shown) positioned either immediately in front of or after the nozzle 170.

All or parts of the working fluid will pass into the gaseous form after the injection. In the first cylinder chamber 150 the pressure of the heated fluid will apply forces to the lower surface of the piston 110, and this will be pushed upwards. The lower cylinder 102 receives heat in that the circulation pump 8, respectively 10, circulates a thermo-fluid between the heat reservoir 9, respectively 11, and the heat exchanger 160 formed by the outer fluid channels 162 formed externally on the lower cylinder 102 and enclosed by the heating casing 161. Part of this heat is heat-exchanged via the cylinder wall of the lower cylinder 102 and in to the working fluid while it is expanding by the piston 110 moving toward the top position (see FIG. 13), and is therefore supplied with extra heat energy during the expansion. (In the FIGS. 12-15 is given that the crankshaft rotates clockwise, as indicated with an arrow.) This entails that working fluid possibly still in the liquid form will continue to evaporate during the expansion. When the piston 110 is around the top position (FIG. 14), the bypass valve 122 is opened by the valve actuator 123 changing its position from closed to open to let the working fluid pass via the bypass 120, so that it expands further from the first cylinder chamber 150 into the second cylinder chamber 151 as the piston 110 is on its way down (FIG. 15). In the embodiment shown, the second cylinder chamber 151 is sufficiently thermally insulated from the rest of the engine and the surroundings, so that there is no heat worth mentioning being transferred to or from the working fluid flowing in here. The working fluid still in the first cylinder chamber 150 is supplied with some more heat from the wall of the second cylinder chamber 151 in the further expansion so that the expansion here will be non-adiabatic, for example polytropic, isothermal, isobaric or something between. The portion of the working fluid flowing into the bypass 120 and further into the second cylinder chamber 151 is not supplied with any extra heat, and the expansion here is thereby adiabatic or at least near-adiabatic. When the piston 110 again reaches the bottom position (FIG. 12), the expansion of the working fluid is completed and the outlet valve 131 opens by the appurtenant valve actuator 132 changing its position, and the working fluid starts to flow out of the second cylinder chamber 151 through an outlet 130, and further into the heat engine cooling course 4 consisting of the recuperator(s) 32, possibly 35, and the cooler 41 and also appurtenant piping, hoses and other relevant components. Due to rotating motion of the crankshaft 117, the piston 110 will move relatively little around the bottom position, and some of the working fluid will then undergo cooling at relatively constant volume, the total volume being constituted by the sum of the volume of the second cylinder chamber 151 and the volume of the cooling course 4. When the piston 110 then again comes out from the bottom position and is on its way upwards (FIG. 13), it will compress the residual amount of working fluid into the cooling course 4, and further cooling will take place. When the piston 110 again reaches the top position, it has displaced nearly the whole amount of working fluid from the second cylinder chamber 151, and the outlet valve 131 closes so that the working fluid is only present in the cooling course 4 wherein it finally undergoes further cooling, but again at constant volume, as the volume of the cooling course 4 will not change substantially since it only consists of relatively stationary components. In the cooling course 4 the working fluid will again condense into pure liquid, and the cycle is completed.

For there always to be sufficient working fluid available for the process, the liquid tank 5 is arranged at the outlet of the cooling course 4, and a surplus of working fluid may flow in and out here as needed.

Figure 17:
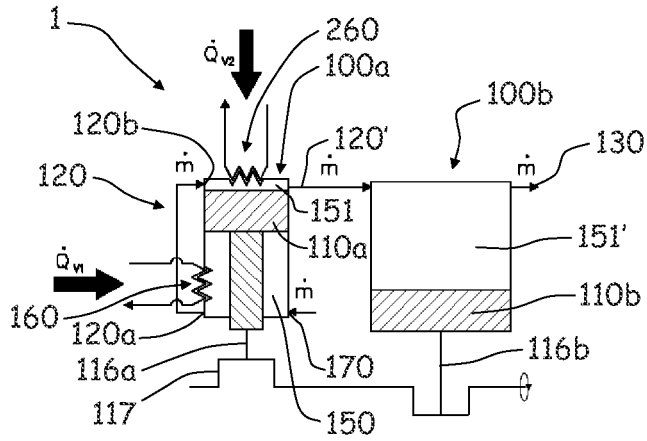
FIG. 17 shows a basic exemplary embodiment of the working mechanism of the invention, having a double-acting cylinder and a heat exchanger in thermal contact with the first expansion chamber, and also a heat exchanger in thermal contact with the second expansion chamber, which in turn is connected to a third expansion chamber in a second, single-acting, near-adiabatic cylinder.

In FIG. 17 is shown a basic exemplary embodiment of the working mechanism of the invention, having a double-acting cylinder assembly 100*a* and a first heat exchanger 160 in thermal contact with the first expansion chamber 150, and also a second heat exchanger 260 in thermal contact with the second expansion chamber 151, in turn connected to a third expansion chamber 151' in a second, single-acting, near-adiabatic cylinder assembly 100*b*. For the sake of clarity, other, like elements are indicated by the suffixes "a" and "b", for example the piston 110*a* of the first cylinder 100*a* and the piston 110*b* of the second cylinder 100*b*.

Figure 18:
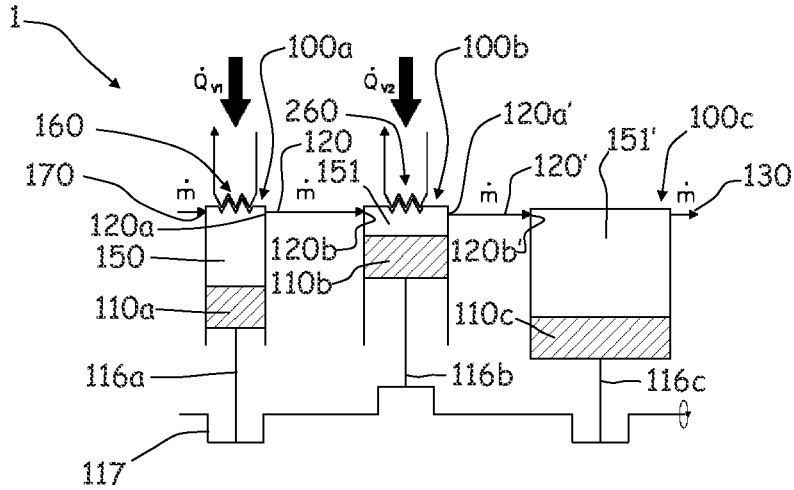
FIG. 18 shows a basic exemplary embodiment of the working mechanism of the invention like the example in FIG. 17, but instead having two single-acting cylinders with respective expansion chambers having internal heat exchangers which in turn are connected to a third expansion chamber in a further single-acting, near-adiabatic cylinder.

In FIG. 18 is shown a basic exemplary embodiment of the working mechanism of the invention like the example in FIG. 17, but having two single-acting cylinders 100*a*, 100*b* with respective expansion chambers 150, 151 having internal heat exchangers 160, 260, in turn connected to a third 151' expansion chamber in a further single-acting near-adiabatic cylinder. For the sake of clarity, other, like elements are indicated by the suffixes "a", "b" and "c" in the same way as describe above for FIG. 17.

Figure 19:
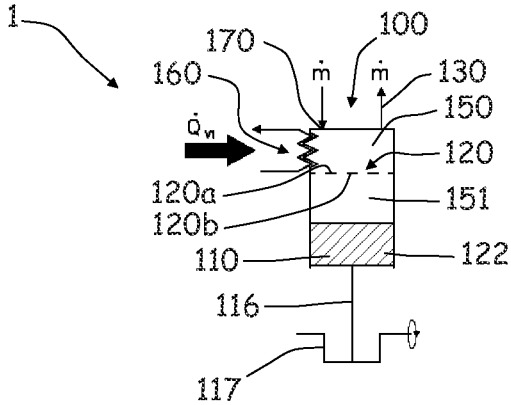
FIG. 19 shows a very simple basic exemplary embodiment of the working mechanism of the invention, where only one single-acting cylinder with an appurtenant piston defines two working chambers in one and the same cylinder volume, and where, in a preferred embodiment, at least one heat exchanger encloses only the first working chamber.

In FIG. 19 is shown a very simple basic exemplary embodiment of the working mechanism of the invention, where only one single-acting cylinder assembly 100 with an appurtenant piston 110 defines two cylinder chambers 150, 151 in one and the same cylinder volume, and where a heat exchanger 160 only encloses the first working chamber 150. Here, the interface between the two working chambers 150, 151 may be regarded as a virtual working-fluid bypass 120 with virtual end portions 120*a*, 120*b*. The piston 110 will function as a bypass valve 122, as, in its top position, it closes the connection between the first and the second cylinder chambers 150, 151.

REFERENCES

US patents:

| Publication number | Publication date | Applicant | Title |
|---|---|---|---|
| 4,133,172 | January 1979 | Cataldo | Modified Ericsson cycle Engine |
| 4,393,653 | July 1983 | Fischer | Reciprocating External Combustion Engine |
| 2009/0000294 A1 | January 2009 | Misselhorn | Power Plant with Heat Transformation |
| 7,076,941 | July 2006 | Hoffman | Externally Heated Engine |

OTHER PUBLICATIONS

"A Dual-Source Organic Rankine Cycle (DORC) for Improved Efficiency in Conversion of Dual Low- and Mid-Grade Heat Sources" —F. David Doty and Siddarth Shevgoor, Proceedings of the ASME 2009 3rd International Conference of Energy Sustainability, Doty Scientific, Inc. 2009.

The invention claimed is:

1. A method for heat-exchanging in and work-exchanging with a working fluid in a heat engine, or a heat pump if the method and its sub-processes are reversed, wherein a thermodynamic cycle for the working fluid is approximately described through the polytropic relation $PV^n$=constant, where P is the pressure, V is the volume and n is the polytropic index of the working fluid with adiabatic index gamma ($\gamma$), and where the engine has at least one working mechanism provided with a first and at least a second volume change chamber, wherein the method in sequence comprises:

a) in a first volume change process, carrying out a first polytropic volume change of the working fluid in a first volume change chamber, where $n<\gamma$, and b) in a second volume change process, carrying out at least one second near-adiabatic or polytropic volume change of the working fluid from a first to a second volume change chamber, where $n<\gamma$, or where a volume change starts with $n<\gamma$ and ends near-adiabatic ($n\approx\gamma$).

2. The method according to claim 1, wherein the method comprises in sequence:

in a first process, carrying out an adiabatic volume change of the working fluid;

in a second process, exchanging heat with the working fluid;

in a third process, carrying out the first volume change process according to step a) above;

in a fourth process, carrying out the first volume change process according to step b) above; and in a fifth process, exchanging heat with the working fluid, where the heat flow direction is the opposite of the heat flow direction in the second process.

3. The method according to claim 1, wherein the method comprises in sequence:

in a first process, carrying out an adiabatic compression of the working fluid;

in a second process, supplying heat to the working fluid;

in a third process, carrying out the first volume change process according to step a) above, where the volume change process comprises expansion;

in a fourth process carrying out the second volume change process according to step b) above, where the volume change process(es) comprise(s) expansion; and in a fifth process, cooling the working fluid.

4. The method according to claim 3, wherein:

the first process involves pumping the working fluid from low to high pressure by means of an injection unit;

the second process involves supplying heat to the working fluid in a heating course positioned externally to the volume change chambers;

the third process involves injecting and expanding the working fluid in the first volume change chamber and at the same time supplying heat to the fluid from at least one heat exchanger in thermal contact with the first volume change chamber;

the fourth process at least involves expanding the working fluid further from the first to the second volume change chamber via a working-fluid bypass; and the fifth process involves cooling the working fluid in a cooling course arranged externally to the expansion chambers.

5. The method according to claim 4, wherein the fourth process more specifically involves expanding the working fluid further from the first to the second volume change chamber via a working-fluid bypass.

6. The method according to claim 4, wherein the fourth process more specifically involves, in a first step, expanding the working fluid further from the first to the second volume change chamber via a working-fluid bypass and, in a second step, expanding the working fluid further from the second volume change chamber to a third volume change chamber via a second working-fluid bypass.

7. The method according to claim 2, wherein the fourth process further involves supplying further heat to the whole or parts of the working fluid from at least a heat exchanger in thermal contact with the first volume change chamber.

8. The method according to claim 2, wherein the fourth process further involves supplying further heat to the whole or parts of the working fluid from at least one heat exchanger in thermal contact with the second volume change chamber.

9. The method according to claim 1, wherein the working fluid alternates between liquid form and gaseous form.

10. The method according to claim 4, wherein the working fluid in the third process is initially in liquid form, as it is injected into the first volume change chamber at a sufficiently high pressure, so that the liquid form is maintained during the injection operation.

11. The method according to claim 9, wherein the working fluid is in the liquid form in the first process; in the liquid form in the second process; wholly or partly supercritical in the second process; wholly or partly in the gaseous form in the third process; substantially being vaporised in the third process; possibly being vaporised further in the fourth process; and substantially being condensed in the fifth process.

12. An external heat engine arrangement having a working fluid, comprising at least one working mechanism provided with a first volume change chamber and at least a second volume change chamber with appurtenant displacement mechanism(s), where at least one heat exchanger is in thermal contact with and encloses or is enclosed by the at least first volume change chamber, the volume change chambers being connected in succession in a fluid-communicating manner through at least one working-fluid bypass, the first volume change chamber having a working-fluid inlet and the second volume change chamber having a working-fluid outlet, wherein the working-fluid inlet, the working-fluid outlet and the at least one working-fluid bypass are provided with valves which are synchronized to maintain a sequential working-fluid flow in succession from the first volume change chamber and through the at least second volume change chamber, the working fluid being carried sequentially through the volume change chambers in a direction of flow from the working-fluid inlet to the working-fluid outlet, wherein a thermodynamic cycle for the working fluid is approximately described through the polytropic relation $PV^n$=constant, where P is the pressure, V is the volume and n is the polytropic index of the working fluid with adiabatic index ($\gamma$), and wherein the first and second volume change chambers are configured to provide a first polytropic volume change of the working fluid in the first volume chamber, where $n<\gamma$, and to provide at least one second near-adiabatic or polytropic volume change of the working fluid from the first volume change chamber to the second volume change chamber, where $n<\gamma$, or where a volume change starts with $n<\gamma$ and ends near-adiabatic ($n\approx\gamma$).

13. The arrangement according to claim 12, wherein the volume change chambers have successively increasing or decreasing volumes.

14. The arrangement according to claim 12, wherein the volume change chambers are arranged to have a function as expansion chambers.

15. The arrangement according to claim 12, wherein the working-fluid bypass is closable by means of at least one bypass valve.

16. The arrangement according to claim 15, wherein a fluid passage between the volume change chambers and respective bypass end portions is maintained in any of the working positions of the displacement mechanism(s) during the displacement of the working fluid between the volume change chambers.

17. The arrangement according to claim 12, wherein the volume change chambers together are arranged to be able to carry out a volume change process for a working fluid, so that the working fluid may be displaced nearly completely from the first into the second volume change chamber and then further in that the displacement mechanism(s) of the volume change chambers are mechanically synchronised.

18. The arrangement according to claim 17, wherein the mechanical synchronisation in the whole or parts of an operating condition maintains displacement between the different volume change chambers having sequentially opposite signs, such that the volume of a first volume change chamber will increase when the volume of a second chamber decreases and vice versa.

* * * * *